US010611625B2

(12) United States Patent
Dudar

(10) Patent No.: US 10,611,625 B2
(45) Date of Patent: Apr. 7, 2020

(54) SYSTEMS AND METHODS FOR DETECTION OF VEHICLE MISFUELING

(71) Applicant: Ford Global Technologies, LLC, Dearborn, MI (US)

(72) Inventor: Aed Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 261 days.

(21) Appl. No.: 15/595,835

(22) Filed: May 15, 2017

(65) Prior Publication Data

US 2018/0327249 A1 Nov. 15, 2018

(51) Int. Cl.

*B65B 3/26* (2006.01)
*B67D 7/34* (2010.01)
*F02M 25/08* (2006.01)

(52) U.S. Cl.

CPC ..... *B67D 7/342* (2013.01); *F02M 25/0872* (2013.01)

(58) Field of Classification Search

CPC ..... F02M 25/0854; F02M 25/089; F02M 25/0836; F02M 2200/0606; B67D 7/342; B60K 2015/03203; F02D 2041/224

See application file for complete search history.

(56) References Cited

U.S. PATENT DOCUMENTS 4,838,323 A 6/1989 Watts
5,113,834 A * 5/1992 Aramaki ..... F02M 25/0809 123/198 D
5,150,689 A * 9/1992 Yano ..... F02M 25/0809 123/198 D
9,328,699 B2 * 5/2016 Dudar ..... F02M 25/0854
9,410,507 B2 * 8/2016 Pearce ..... F02M 25/0809
9,448,098 B2 * 9/2016 Dudar ..... G01F 23/22
2003/0209280 A1 11/2003 Zerangue, Sr.
2014/0360260 A1 * 12/2014 Dudar ..... G01F 23/22 73/204.11
2015/0083088 A1 * 3/2015 Pearce ..... F02M 25/0809 123/520
2015/0090234 A1 4/2015 Dudar et al.
2015/0226138 A1 8/2015 Yang et al.
2016/0341156 A1 * 11/2016 Yang ..... F02M 25/0854

OTHER PUBLICATIONS

Brignall, M., "£9,000 bill for misfuelling has both driver and engine spluttering," The Guardian, Available Online at https://www.theguardian.com/money/2015/sep/9000-bill-misfueling-enterprise-hire-car, Sep. 12, 2015, 4 pages.

Dudar, A., "Systems and Methods for Detection of Vehicle Misfueling," U.S. Appl. No. 15/289,791, filed Oct. 10, 2016, 108 pages.

* cited by examiner

*Primary Examiner* — Reinaldo Sanchez-Medina
(74) *Attorney, Agent, or Firm* — Geoffrey Brumbaugh; McCoy Russell LLP

(57) ABSTRACT

Methods and systems are provided for identifying misfueling in a vehicle fuel tank when an incorrect fuel type is provided. In one example, a method may include routing fuel vapors from a vehicle fuel tank to a fuel vapor storage canister and monitoring a temperature profile of a fuel system canister during a refueling operation, and when an actual temperature profile is below an expected temperature profile, misfueling is identified. Further, responsive to an indication of misfueling, further addition of fuel is disabled during the refueling event.

16 Claims, 8 Drawing Sheets

SYSTEMS AND METHODS FOR DETECTION OF VEHICLE MISFUELING

FIELD

The present description relates generally to methods and systems for detecting misfueling during a refueling event.

BACKGROUND/SUMMARY

Refueling stations for vehicles may have fuel dispenser pumps that dispense gasoline (or a gasoline fuel blend) or diesel fuel, to accommodate vehicles that run off of either fuel type. However, if diesel fuel is unknowingly introduced into a gasoline engine, engine parts may be damaged. For example, due to diesel fuel being heavier than gasoline, the introduction of diesel fuel into a gasoline engine may result in clogging of fuel injectors. In addition, the misfueling can result in spontaneous ignition of the diesel fuel inside gasoline engine cylinders. This can result in high costs associated with repairing and replacing engine components. In addition to costs associated with draining out the diesel fuel and flushing fuel system components such as the fuel pump, fuel filter, and fuel injectors.

To discourage the introduction of diesel fuel into gasoline engines (or vice versa), many gas stations include refueling nozzles that differ for gasoline compared to diesel fuel. For example, gasoline dispenser nozzles may differ from diesel nozzles in diameter, such that nozzles designed for diesel fuel do not readily fit into a fuel filler neck of a gasoline engine. In still other examples, dispenser nozzles may additionally or alternatively be color coded, to clearly demarcate to a dispenser operator which nozzles are for gasoline as compared to diesel fuel. However, there may be refueling stations where a similar nozzle diameter and color is used for both diesel and gasoline fuels, increasing the likelihood of potential misfueling of a vehicle fuel tank. Accordingly, various approaches have been developed for detecting and mitigating further misfueling.

One example approach for detecting misfueling is shown by Zerangue et al. in US 20030209280. Therein, once a fuel nozzle is inserted into the filler neck, a vacuum pump is activated to create a seal around the fuel nozzle. The type of dispensed fuel is then identified via a sensing unit by measuring the dispensed fuel vapor pressure and comparing it to predetermined vapor pressure values. If misfueling is detected, the sensing unit actuates a valve, which is affixed across the filler neck passageway, to a closed position. Once the valve is closed, the backpressure in the fuel tank increases which engages the fuel pump's internal shut-off mechanism, disabling any more of the incorrect fuel from being dispensed into the fuel tank.

However, the inventors herein have recognized potential issues with such an approach. Specifically, there may be markets where the installation of a sensing unit to identify fuel based on vapor pressure (e.g. Fuel Tank Pressure Transducer (FTPT) sensor) is not required, such as in most countries in Europe and Asia (e.g. China and India). Furthermore, the addition of a vacuum pump (coupled to the sensing unit) in the refueling system may add significant component cost.

The inventors herein have recognized that the differences in fuel pressure between gasoline and diesel may lead to different rates of vapor adsorption in a carbon canister coupled to the fuel tank. In particular, gasoline, which is more volatile than diesel due to the presence of shorter chain hydrocarbons, may evaporate more rapidly than diesel in response to diurnal variations in ambient temperature. Due to the higher evaporation rate, during a refueling event with gasoline, a larger amount of fuel vapors are adsorbed in the carbon canister. The exothermic reaction associated with vapor adsorption in the canister results in an increase in canister temperature. In comparison, due to the lower evaporation rate, during a refueling event with diesel, a smaller amount of fuel vapors are adsorbed in the carbon canister, resulting in a negligible exothermic reaction. Therefore a temperature gain of the carbon canister during a refueling event may be advantageously used for inferring misfueling.

In one example, misfueling may be timely detected and addressed by a method, comprising: responsive to misfueling of a fuel tank identified based on an actual temperature profile at a fuel system canister during a refueling event relative to an expected temperature profile, the expected temperature profile based on a fuel level in the fuel tank, disabling further addition of fuel during the refueling event. In this way, misfueling may be promptly detected, and further filling of a fuel tank with an incorrect fuel may be averted.

As an example, during refueling, an actual fuel level in a fuel tank may be monitored via a fuel level sensor and an expected temperature gain in a fuel vapor canister coupled to the fuel tank may be estimated based on the fuel level and the expected fuel type. For example, when the expected fuel in the fuel tank is gasoline, an expected temperature gain of the canister may be calculated based on the fuel level and the evaporation rate (or volatility) of gasoline. An actual temperature gain is then determined via a temperature sensor coupled to the canister, such as one or more thermocouples positioned at different locations inside the canister. Based on the actual temperature gain being lower than the expected temperature gain, misfueling may be inferred. For example, it may be inferred that the fuel tank is being incorrectly filled with a lower volatility fuel, such as diesel. In response to the indication of misfueling, a fuel tank isolation valve may be commanded closed to actively raise a filler pipe pressure and induce a shut off of the refueling dispenser, thereby mitigating the further addition of the incorrect fuel type to the fuel tank. Furthermore, the vehicle operator may be alerted that misfueling has occurred so that appropriate mitigating actions may be taken.

In this way, misfueling may be detected based on a temperature change within a fuel vapor canister during a refueling event. By relying on the effect of adsorbed fuel vapors on a temperature gain at the canister, temperature changes in the fuel vapor canister during refueling may be correlated with the presence of an incorrect fuel (e.g., a fuel having a different volatility than the expected fuel) in the fuel tank while using existing temperature sensors. By relying on inexpensive canister temperature sensors (or thermocouples), misfueling may be detected in a more cost-effective manner, with reduced reliance on expensive and bulky hardware such as vacuum pumps. By sealing the fuel tank responsive to the indication of misfueling, further addition of the incorrect fuel into the fuel tank is pre-empted.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
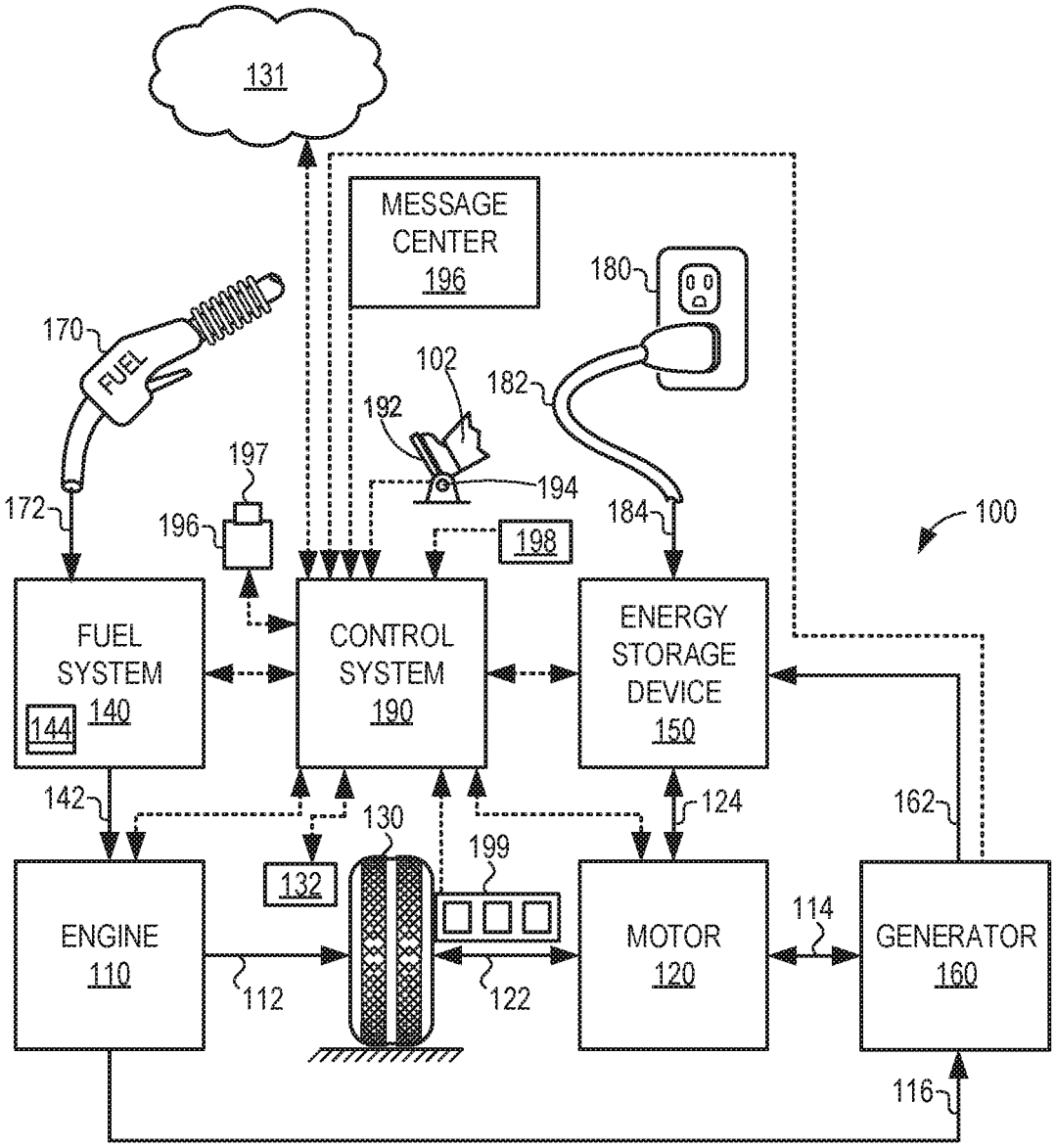
FIG. 1 shows a schematic depiction of a vehicle propulsion system.
Figure 2:
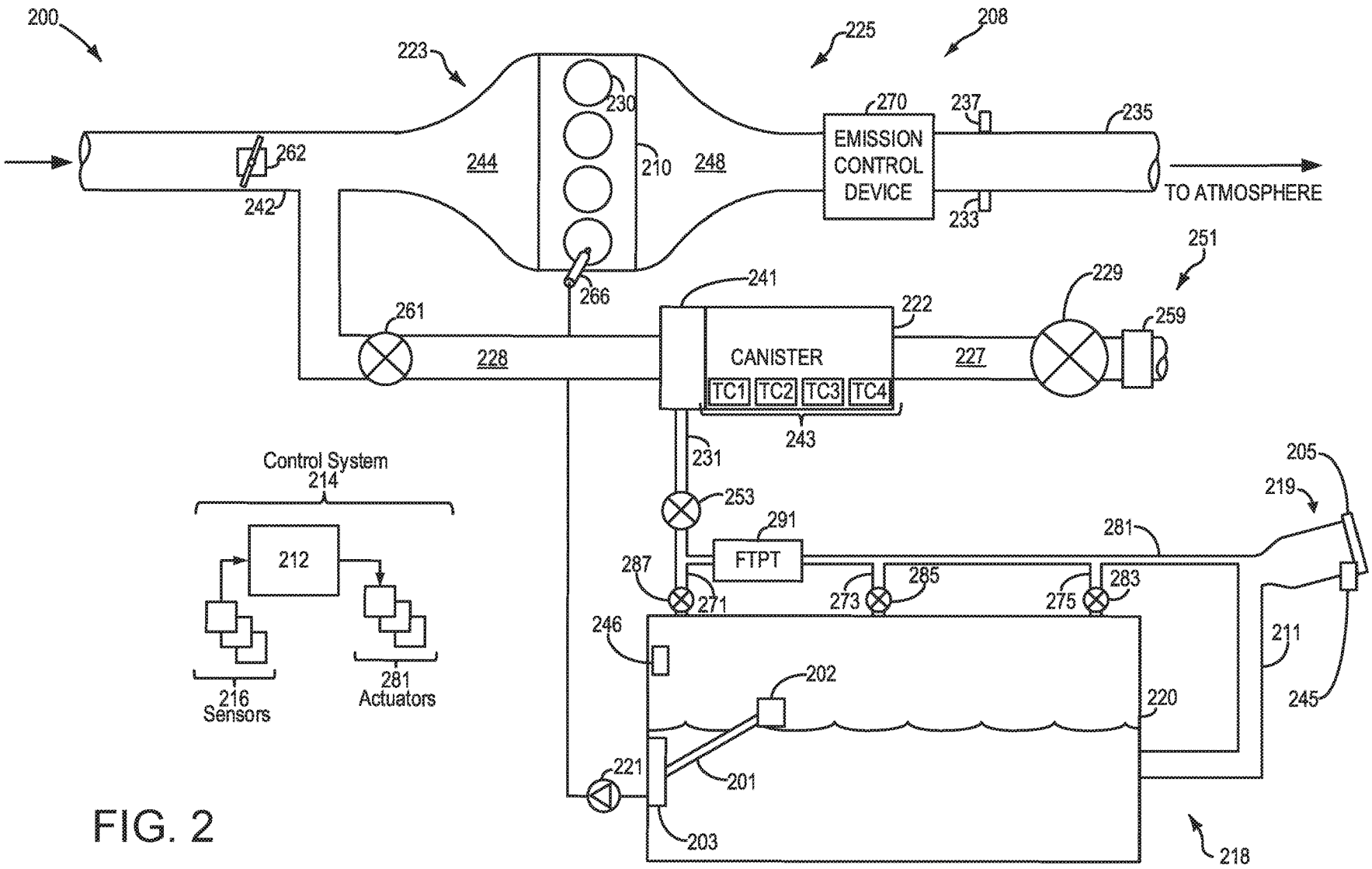
FIG. 2 shows a schematic diagram of a vehicle fuel system and associated evaporative emission control system.
Figure 5:
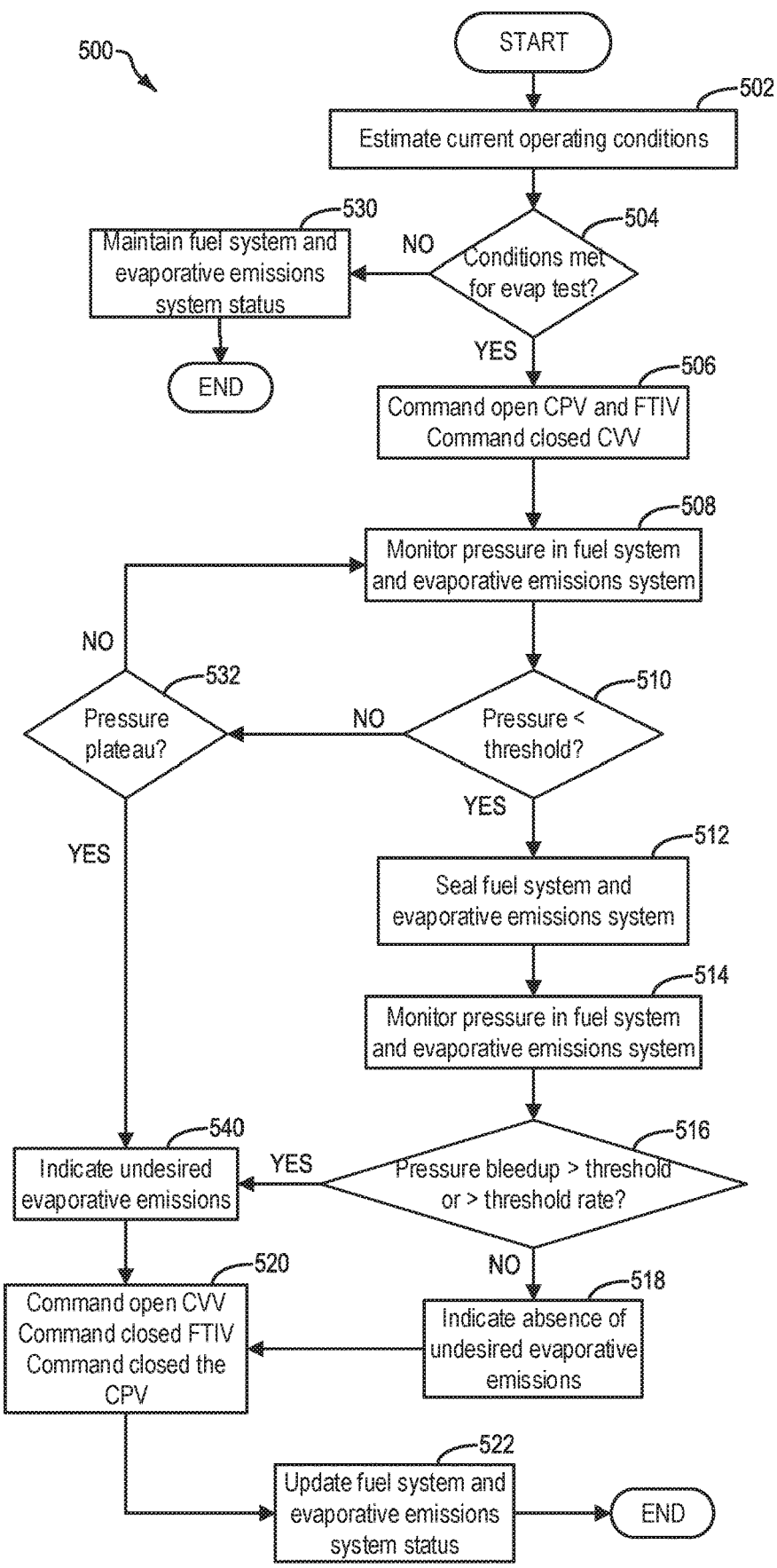
FIG. 5 depicts a high-level flowchart for an example routine for conducting an evaporative emission test diagnostic procedure.
Figure 6:
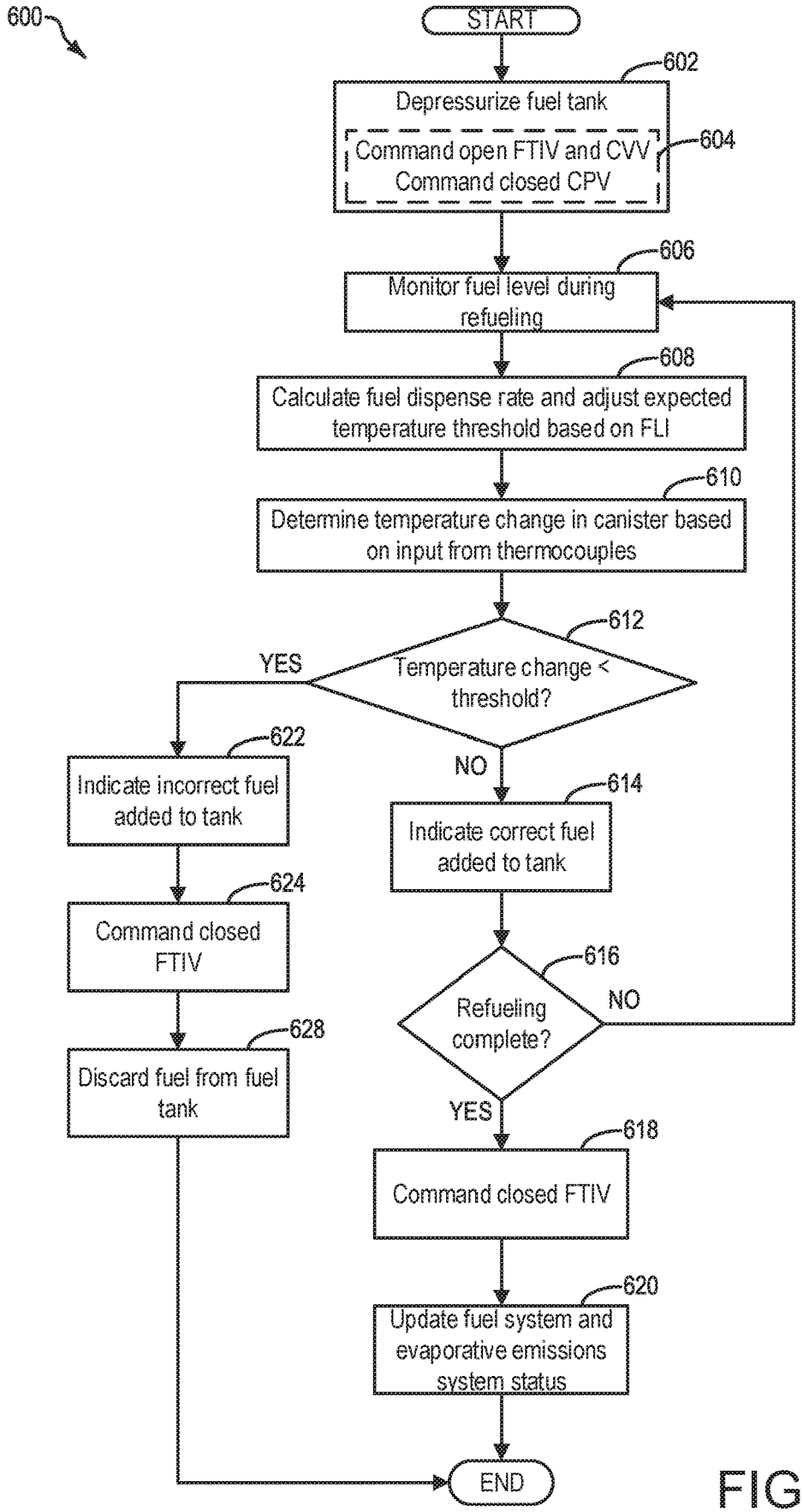
FIG. 6 depicts a high-level flowchart for an example routine for conducting misfueling diagnostic during a refueling event.
Figure 7:
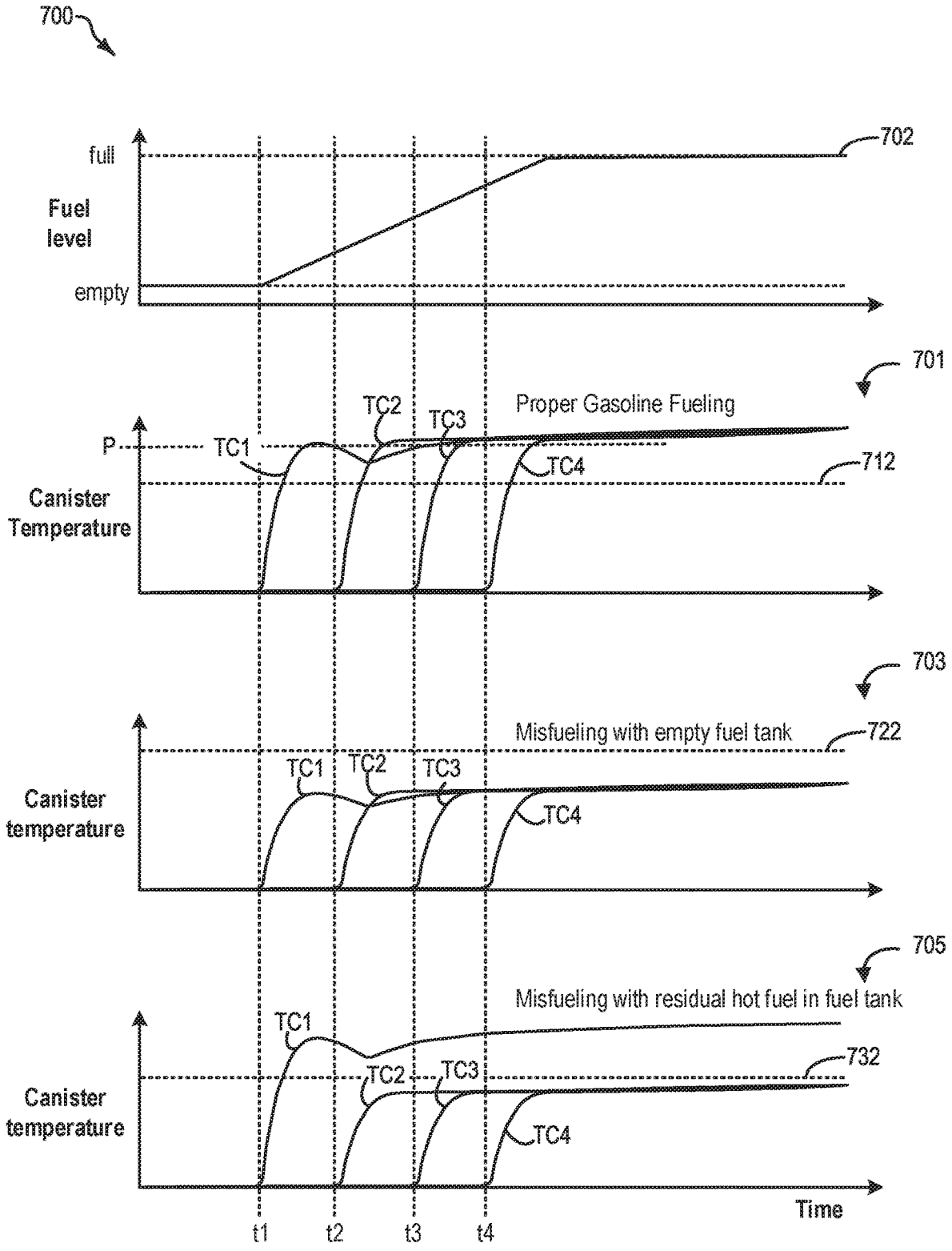
FIG. 7 illustrates an example temperature changes based on plurality of temperature sensors in a carbon canister during a refueling event.
Figure 8:
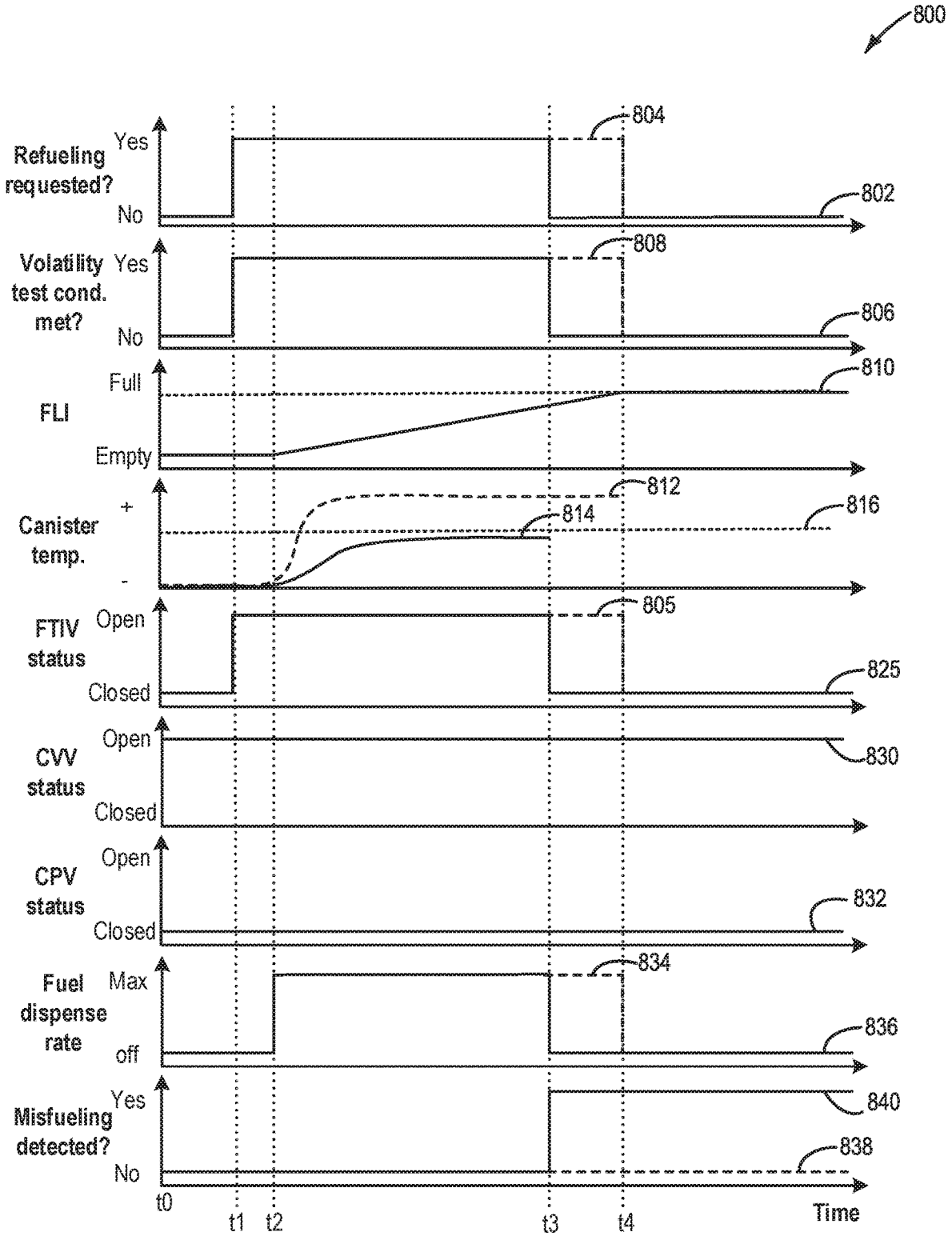
FIG. 8 shows a graph illustrating an example misfueling diagnostic during a refueling event.

The following description relates to systems and methods for detecting the addition of an incorrect fuel type to a vehicle fuel tank during a refueling event. The fuel tank may be included in a vehicle, such as a hybrid electric vehicle, as shown in FIG. 1. The vehicle shown in FIG. 1, may include a fuel system and an evaporative emissions system, as shown by FIG. 2. The evaporative emission control system of FIG. 2 may include a carbon canister with one or more temperature sensors disposed at various locations within the canister, such as the carbon canister shown in FIG. 3. During a refueling event, a controller of the vehicle may be configured to perform a control routine for diagnosing misfueling, such as the example routine of FIGS. 4 and 6. The controller may infer misfueling upon confirming that there are no system leaks (FIG. 5). Further, the controller may infer misfueling based on a measured temperature change at the canister, as shown in FIG. 6. An example of temperature changes within the canister during a refueling event is illustrated in FIG. 7. A prophetic example of identifying misfueling during a refueling event is illustrated in FIG. 8.

Turning now to the figures, FIG. 1 illustrates an example vehicle propulsion system 100. Vehicle propulsion system 100 includes a fuel burning engine 110 and a motor 120. As a non-limiting example, engine 110 comprises an internal combustion engine and motor 120 comprises an electric motor. Motor 120 may be configured to utilize or consume a different energy source than engine 110. For example, engine 110 may consume a liquid fuel (e.g., gasoline) to produce an engine output while motor 120 may consume electrical energy to produce a motor output. A detailed embodiment of engine 110 is shown with reference to FIG. 2. As such, a vehicle with propulsion system 100 may be referred to as a hybrid electric vehicle (HEV).

Vehicle propulsion system 100 may utilize a variety of different operational modes depending on operating conditions encountered by the vehicle propulsion system. Some of these modes may enable engine 110 to be maintained in an off state (i.e., set to a deactivated state) where combustion of fuel at the engine is discontinued. For example, under select operating conditions, motor 120 may propel the vehicle via drive wheel 130 as indicated by arrow 122 while engine 110 is deactivated.

During other operating conditions, engine 110 may be set to a deactivated state (as described above) while motor 120 may be operated to charge energy storage device 150. For example, motor 120 may receive wheel torque from drive wheel 130 as indicated by arrow 122 where the motor may convert the kinetic energy of the vehicle to electrical energy for storage at energy storage device 150 as indicated by arrow 124. This operation may be referred to as regenerative braking of the vehicle. Thus, motor 120 can provide a generator function in some examples. However, in other examples, generator 160 may instead receive wheel torque from drive wheel 130, where the generator may convert the kinetic energy of the vehicle to electrical energy for storage at energy storage device 150 as indicated by arrow 162.

During still other operating conditions, engine 110 may be operated by combusting fuel received from fuel system 140 as indicated by arrow 142. For example, engine 110 may be operated to propel the vehicle via drive wheel 130 as indicated by arrow 112 while motor 120 is deactivated. During other operating conditions, both engine 110 and motor 120 may each be operated to propel the vehicle via drive wheel 130 as indicated by arrows 112 and 122, respectively. A configuration where both the engine and the motor may selectively propel the vehicle may be referred to as a parallel type vehicle propulsion system. Note that in some examples, motor 120 may propel the vehicle via a first set of drive wheels and engine 110 may propel the vehicle via a second set of drive wheels.

In other examples, vehicle propulsion system 100 may be configured as a series type vehicle propulsion system, whereby the engine does not directly propel the drive wheels. Rather, engine 110 may be operated to power motor 120, which may in turn propel the vehicle via drive wheel 130 as indicated by arrow 122. For example, during select operating conditions, engine 110 may drive generator 160 as indicated by arrow 116, which may in turn supply electrical energy to one or more of motor 120 as indicated by arrow 114 or energy storage device 150 as indicated by arrow 162. As another example, engine 110 may be operated to drive motor 120 which may in turn provide a generator function to convert the engine output to electrical energy, where the electrical energy may be stored at energy storage device 150 for later use by the motor.

Fuel system 140 may include one or more fuel storage tanks 144 for storing fuel on-board the vehicle. For example, fuel tank 144 may store one or more liquid fuels, including but not limited to: gasoline, diesel, and alcohol fuels. The fuel system equipped with the evaporative emission control system will be described in more detail in FIG. 2. In some examples, the fuel may be stored on-board the vehicle as a blend of two or more different fuels. For example, fuel tank 144 may be configured to store a blend of gasoline and ethanol (e.g., E10, E85, etc.) or a blend of gasoline and methanol (e.g., M10, M85, etc.), whereby these fuels or fuel blends may be delivered to engine 110 as indicated by arrow 142. Still other suitable fuels or fuel blends may be supplied to engine 110, where they may be combusted at the engine to produce an engine output. The engine output may be utilized to propel the vehicle as indicated by arrow 112 or to recharge energy storage device 150 via motor 120 or generator 160.

In some examples, energy storage device 150 may be configured to store electrical energy that may be supplied to other electrical loads residing on-board the vehicle (other than the motor), including cabin heating and air conditioning, engine starting, headlights, cabin audio and video systems, etc. As a non-limiting example, energy storage device 150 may include one or more batteries and/or capacitors.

Control system 190 may communicate with one or more of engine 110, motor 120, fuel system 140, energy storage device 150, and generator 160. Control system 190 may receive sensory feedback information from one or more of engine 110, motor 120, fuel system 140, energy storage device 150, and generator 160. Further, control system 190 may send control signals to one or more of engine 110, motor 120, fuel system 140, energy storage device 150, and generator 160 responsive to this sensory feedback. Control system 190 may receive an indication of an operator requested output of the vehicle propulsion system from a vehicle operator 102. For example, control system 190 may receive sensory feedback from pedal position sensor 194 which communicates with pedal 192. Pedal 192 may refer schematically to a brake pedal and/or an accelerator pedal.

Energy storage device 150 may periodically receive electrical energy from a power source 180 residing external to the vehicle (e.g., not part of the vehicle) as indicated by arrow 184. As a non-limiting example, vehicle propulsion system 100 may be configured as a plug-in hybrid electric vehicle (HEV), whereby electrical energy may be supplied to energy storage device 150 from power source 180 via an electrical energy transmission cable 182. During a recharging operation of energy storage device 150 from power source 180, electrical transmission cable 182 may electrically couple energy storage device 150 and power source 180. While the vehicle propulsion system is operated to propel the vehicle, electrical transmission cable 182 may disconnected between power source 180 and energy storage device 150. Control system 190 may identify and/or control the amount of electrical energy stored at the energy storage device, which may be referred to as the state of charge (SOC).

In other examples, electrical transmission cable 182 may be omitted, where electrical energy may be received wirelessly at energy storage device 150 from power source 180. For example, energy storage device 150 may receive electrical energy from power source 180 via one or more of electromagnetic induction, radio waves, and electromagnetic resonance. As such, it should be appreciated that any suitable approach may be used for recharging energy storage device 150 from a power source that does not comprise part of the vehicle. In this way, motor 120 may propel the vehicle by utilizing an energy source other than the fuel utilized by engine 110.

Fuel system 140 may periodically receive fuel from a fuel source residing external to the vehicle. As a non-limiting example, vehicle propulsion system 100 may be refueled by receiving fuel via a fuel dispensing device 170 as indicated by arrow 172. In some examples, fuel tank 144 may be configured to store the fuel received from fuel dispensing device 170 until it is supplied to engine 110 for combustion. In some examples, control system 190 may receive an indication of the level of fuel stored at fuel tank 144 via a fuel level sensor. The level of fuel stored at fuel tank 144 (e.g., as identified by the fuel level sensor) may be communicated to the vehicle operator, for example, via a fuel gauge or indication in a vehicle instrument panel 196.

The vehicle propulsion system 100 may also include an ambient temperature/humidity sensor 198, and a roll stability control sensor, such as a lateral and/or longitudinal and/or yaw rate sensor(s) 199. The vehicle instrument panel 196 may include indicator light(s) and/or a text-based display in which messages are displayed to an operator. The vehicle instrument panel 196 may also include various input portions for receiving an operator input, such as buttons, touch screens, voice input/recognition, etc. For example, the vehicle instrument panel 196 may include a refueling button 197 which may be manually actuated (e.g., pressed) by a vehicle operator to initiate refueling. For example, as described in more detail below, in response to the vehicle operator actuating refueling button 197, a fuel tank in the vehicle may be depressurized so that refueling may be performed.

Control system 190 may be communicatively coupled to other vehicles or infrastructures using appropriate communications technology, as is known in the art. For example, control system 190 may be coupled to other vehicles or infrastructures via a wireless network 131, which may comprise Wi-Fi, Bluetooth, a type of cellular service, a wireless data transfer protocol, and so on. Control system 190 may broadcast (and receive) information regarding vehicle data, vehicle diagnostics, traffic conditions, vehicle location information, vehicle operating procedures, etc., via vehicle-to-vehicle (V2V), vehicle-to-infrastructure-to-vehicle (V2I2V), and/or vehicle-to-infrastructure (V2I) technology. The communication and the information exchanged between vehicles can be either direct between vehicles, or can be multi-hop. In some examples, longer range communications (e.g. WiMax) may be used in place of, or in conjunction with, V2V, or V2I2V, to extend the coverage area by a few miles. In still other examples, vehicle control system 190 may be communicatively coupled to other vehicles or infrastructures via a wireless network 131 and the internet (e.g. cloud), as is commonly known in the art.

Vehicle system 100 may also include an on-board navigation system 132 (for example, a Global Positioning System) that an operator of the vehicle may interact with. The navigation system 132 may include one or more location sensors for assisting in estimating vehicle speed, vehicle altitude, vehicle position/location, etc. This information may be used to infer engine operating parameters, such as local barometric pressure. As discussed above, control system 190 may further be configured to receive information via the internet or other communication networks. Information received from the GPS may be cross-referenced to information available via the internet to determine local weather conditions, local vehicle regulations, etc. In one example, information received from the GPS may be cross-referenced to information available via the internet to indicate a climate and locality of a vehicle. Further, the sensor(s) 199 may include a vertical accelerometer to indicate road roughness. These devices may be connected to control system 190. In one example, the control system may adjust engine output and/or the wheel brakes to increase vehicle stability in response to sensor(s) 199.

Turning now to FIG. 2, an example vehicle system 200 with a fuel system 218 and an evaporative emission control system 251 is shown. Emission control system 251 includes a fuel vapor container or canister 222 which may be used to capture and store fuel vapors.

The engine system 208 may include an engine 210 having a plurality of cylinders 230. The engine 210 includes an engine intake 223 and an engine exhaust 225. The engine intake 223 includes a throttle 262 fluidly coupled to the engine intake manifold 244 via an intake passage 242. The engine exhaust 225 includes an exhaust manifold 248 leading to an exhaust passage 235 that routes exhaust gas to the atmosphere. The engine exhaust 225 may include one or more emission control devices 270, which may be mounted in a close-coupled position in the exhaust. One or more emission control devices may include a three-way catalyst, lean NOx trap, diesel particulate filter, oxidation catalyst, etc. It will be appreciated that other components may be included in the engine such as a variety of valves and sensors.

Fuel system 218 may include a fuel tank 220 coupled to a fuel pump system 221. The fuel pump system 221 may include one or more pumps for pressurizing fuel delivered to the injectors of engine 210, such as the example injector 266 shown. While only a single injector 266 is shown, additional injectors are provided for each cylinder. It will be appreciated that fuel system 218 may be a return-less fuel system, a return fuel system, or various other types of fuel system. Fuel tank 220 may include a temperature sensor 246 disposed therein.

A fuel level sensor 203 may be included in fuel tank 220 to determine an amount of fuel in the fuel tank. For example, fuel level sensor 203 may include an arm 201 coupled to a float 202. In this example, the position of the float 202 on the top surface of the fuel volume may be used to determine a fuel level in the fuel tank. Further, fuel vapor canister 222 may be used as a secondary source for determining an amount of fuel in the fuel tank. For example, vapors generated in fuel system 218 may be routed to an evaporative emissions control system 251 which includes a fuel vapor canister 222 via vapor recovery line 231, before being purged to the engine intake 223. Fuel vapor canister 222 may include a buffer or load port 241 to which fuel vapor recovery line 231 is coupled. Further, one or more temperature sensors 243 (e.g. TC1-TC4) may be included in fuel vapor canister 222 so that temperature changes in the fuel vapor canister may be monitored to infer fuel levels in the fuel tank as described below. The one or more temperature sensors 243 may be located within canister 222 at any suitable locations. For example, canister 222 may include a temperature sensor adjacent to load port 241 and/or at various depths within the adsorbent in the canister. An example canister including one or more temperature sensors will be elaborated in more detail in FIG. 3. In the depicted example, fuel system 218 includes a single canister. However, in alternate examples, one or more canisters may be provided.

Fuel vapors undergo an exothermic reaction when carbon in the canister adsorbs vapor from the fuel tank thus temperatures of the fuel vapor canister, e.g., as determined by the one or more temperature sensors 243, may increase when vapors dispensed by a refueling pump enter the canister and get adsorbed into activated charcoal in the canister. During a refueling event, the exothermic reaction associated with vapor adsorption in the canister leads to an increase in temperature at the canister. As more fuel is dispensed into the fuel tank, portions of the canister may become saturated so that the vapor flowing through the canister cools the adsorbent in the canister leading to a slight decrease in temperature in the canister. At the end of refueling, vapor diffusion from downstream portions of the adsorbent in the canister may cause a heating effect wherein the temperature again increases in the canister. As described in more detail in FIGS. 3-8 below, these temperature changes in the canister may be used to infer misfueling during a refueling event.

Vapor recovery line 231 may be coupled to fuel tank 220 via one or more conduits and may include one or more valves for isolating the fuel tank during certain conditions. For example, vapor recovery line 231 may be coupled to fuel tank 220 via one or more or a combination of conduits 271, 273, and 275. Further, in some examples, one or more fuel tank isolation valves may be included in recovery line 231 or in conduits 271, 273, or 275. Among other functions, fuel tank isolation valves may allow a fuel vapor canister of the emissions control system to be maintained at a low pressure or vacuum without increasing the fuel evaporation rate from the tank (which would otherwise occur if the fuel tank pressure were lowered). For example, conduit 271 may include a grade vent valve (GVV) 287, conduit 273 may include a fill limit venting valve (FLVV) 285, and conduit 275 may include a grade vent valve (GVV) 283, and/or conduit 231 may include an isolation valve 253. Further, in some examples, recovery line 231 may be coupled to a fuel filler system 219. In some examples, fuel filler system 219 may include a fuel cap 205 for sealing off the fuel filler system from the atmosphere. Fuel filler system 219 is coupled to fuel tank 220 via a fuel filler pipe or neck 211. Further, a fuel cap locking mechanism 245 may be coupled to fuel cap 205. The fuel cap locking mechanism may be configured to automatically lock the fuel cap in a closed position so that the fuel cap cannot be opened. For example, the fuel cap 205 may remain locked via locking mechanism 245 while pressure or vacuum in the fuel tank is greater than a threshold. In response to a refuel request, e.g. a vehicle operator initiated request, the fuel tank may be depressurized and the fuel cap unlocked after the pressure or vacuum in the fuel tank falls below the threshold. Fuel cap locking mechanism 245 may be a latch or clutch, which, when engaged, prevents removal of the fuel cap. The latch or clutch may be electrically locked, for example, by a solenoid, or may be mechanically locked, for example, by a pressure diaphragm.

In some examples, fuel cap locking mechanism 245 may be a filler pipe valve located at a mouth of fuel filler pipe 211. In such examples, fuel cap locking mechanism 245 may prevent the insertion of a refueling pump into fuel filler pipe 211. The filler pipe valve may be electrically locked, for example, by a solenoid, or mechanically locked, for example by a pressure diaphragm.

In some examples, fuel cap locking mechanism 245 may be a refueling door lock, such as latch or a clutch which locks a refueling door located in a body panel of the vehicle. The refueling door may be electrically locked, for example by a solenoid, or mechanically locked, for example by a pressure diaphragm.

In examples where fuel cap locking mechanism 245 is locked using an electrical mechanism, fuel cap locking mechanism 245 may be unlocked by commands from controller 212, for example, when a fuel tank pressure decreases below a pressure threshold. In examples where fuel cap locking mechanism 245 is locked using a mechanical mechanism, fuel cap locking mechanism 245 may be unlocked via a pressure gradient, for example, when a fuel tank pressure decreases to atmospheric pressure.

A fuel tank pressure transducer (FTPT) 291, or fuel tank pressure sensor, may be included between the fuel tank 220 and fuel vapor canister 222, to provide an estimate of a fuel tank pressure. The fuel tank pressure transducer may alternately be located in vapor recovery line 231, purge line 228, vent line 227, or other location within emission control system 251 without affecting its engine-off leak detection ability. As another example, one or more fuel tank pressure sensors may be located within fuel tank 220.

Emissions control system 251 may include one or more emissions control devices, such as one or more fuel vapor canisters, e.g., fuel vapor canister 222, filled with an appropriate adsorbent, the canisters are configured to temporarily trap fuel vapors (including vaporized hydrocarbons) during fuel tank refilling operations and "running loss" (that is, fuel vaporized during vehicle operation). In one example, the adsorbent used is activated charcoal. Emissions control system 251 may further include a canister ventilation path or vent line 227 which may route gases out of the canister 222 to the atmosphere when storing, or trapping, fuel vapors from fuel system 218.

Vent line 227 may also allow fresh air to be drawn into canister 222 when purging stored fuel vapors from fuel system 218 to engine intake 223 via purge line 228 and purge valve 261. For example, purge valve 261 may be normally closed but may be opened during certain conditions so that vacuum from engine intake 244 is provided to the fuel vapor canister for purging. In some examples, vent line 227 may include an air filter 259 disposed therein upstream of a canister 222.

In some examples, the flow of air and vapors between canister 222 and the atmosphere may be regulated by a canister vent valve 229 coupled within vent line 227. When included, the canister vent valve 229 may be a normally open valve, so that fuel tank isolation valve 253 (FTIV) may control venting of fuel tank 220 to the atmosphere. When included, the CVV may be opened during fuel vapor storing operations (for example, during fuel tank refueling and while the engine is not running) so that air, stripped of fuel vapor after having passed through the canister, can be pushed out to the atmosphere. Likewise, during purging operations (for example, during canister regeneration and while the engine is running), the CVV may be opened to allow a flow of fresh air to strip the fuel vapors stored in the canister. In some examples, CVV 229 may be a solenoid valve wherein opening or closing of the valve is performed via actuation of a canister vent solenoid. In particular, the canister vent valve may be closed upon actuation of the canister vent solenoid. In some examples, CVV 229 may be configured as a latchable solenoid valve. In other words, when the valve is placed in a closed configuration, it latches closed without requiring additional current or voltage. For example, the valve may be closed with a 100 ms pulse, and then opened at a later time point with another 100 ms pulse. In this way, the amount of battery power required to maintain the CVV closed is reduced. In particular, the CVV may be closed while the vehicle is off, thus maintaining battery power while maintaining the fuel emissions control system sealed from atmosphere. In addition, FTIV 253 may be a normally closed valve, that when opened, allows for the venting of fuel vapors from fuel tank 220 to fuel vapor canister 222. Fuel vapors may then be vented to atmosphere, or purged to engine intake system 223 via canister purge valve 261.

Fuel system 218 may be operated by controller 212 in a plurality of modes by selective adjustment of the various valves and solenoids. For example, the fuel system may be operated in a fuel vapor storage mode (e.g., during a fuel tank refueling operation and with the engine not combusting air and fuel), wherein the controller 212 may open isolation valve 253 while closing canister purge valve (CPV) 261 to direct refueling vapors into canister 222 while preventing fuel vapors from being directed into the intake manifold.

As another example, the fuel system may be operated in a refueling mode (e.g., when fuel tank refueling is requested by a vehicle operator), wherein the controller 212 may open isolation valve 253, while maintaining canister purge valve 261 closed, to depressurize the fuel tank before allowing enabling fuel to be added therein. As such, isolation valve 253 may be kept open during the refueling operation to allow refueling vapors to be stored in the canister. After refueling is completed, the isolation valve may be closed. Further, if misfueling is detected (e.g., when the diesel fuel is dispensed into gasoline fuel tank), the controller 212 may be configured to actively close isolation valve 253. By sealing the fuel tank responsive to the indication of misfueling, further addition of the incorrect fuel into the fuel tank is pre-empted.

As yet another example, the fuel system may be operated in a canister purging mode (e.g., after an emission control device light-off temperature has been attained and with the engine combusting air and fuel), wherein the controller 212 may open canister purge valve 261 while closing isolation valve 253. Herein, the vacuum generated by the intake manifold of the operating engine may be used to draw fresh air through vent 227 and through fuel vapor canister 222 to purge the stored fuel vapors into intake manifold 244. In this mode, the purged fuel vapors from the canister are combusted in the engine. The purging may be continued until the stored fuel vapor amount in the canister is below a threshold.

Controller 212 may comprise a portion of a control system 214. In some examples, control system 214 may be the same as control system 190, illustrated in FIG. 1. Control system 214 is shown receiving information from a plurality of sensors 216 (various examples of which are described herein) and sending control signals to a plurality of actuators 281 (various examples of which are described herein). As one example, sensors 216 may include exhaust gas sensor 237 located upstream of the emission control device 270, temperature sensor 233, pressure sensor 291, and canister temperature sensor 243. Other sensors such as pressure, temperature, air/fuel ratio, and composition sensors may be coupled to various locations in the vehicle system 206. As another example, the actuators may include throttle 262, fuel tank isolation valve 253, canister purge valve 261, and canister vent valve 229. The control system 214 may include a controller 212. The controller may receive input data from the various sensors, process the input data, and trigger the actuators in response to the processed input data based on instruction or code programmed therein corresponding to one or more routines. Example control routines are described herein with regard to FIGS. 4-6. For example, responsive to indication of a refueling request, the controller may send a control signal to a fuel tank isolation valve actuator to move the valve to an open position so that refueling vapors can be absorbed and stored in the fuel system carbon canister. As another example, responsive to sensor input indicative of a higher than threshold fuel vapor load in the canister, the controller may send a control signal to a canister purge valve actuator to move the valve to an open position so that intake manifold vacuum from a running engine can be applied on the fuel system carbon canister, and the desorbed fuel vapors can be purged into the engine cylinders.

In some examples, the controller may be placed in a reduced power mode or sleep mode, wherein the controller maintains essential functions only, and operates with a lower battery consumption than in a corresponding awake mode. For example, the controller may be placed in a sleep mode following a vehicle-off event in order to perform a diagnostic routine at a duration after the vehicle-off event. The controller may have a wake input that allows the controller to be returned to an awake mode based on an input received from one or more sensors. For example, the opening of a vehicle door may trigger a return to an awake mode. In other examples, particularly with regard to the methods depicted in FIG. 4 and FIG. 6, the controller may need to be awake in order to conduct such methods. In such an example, the controller may stay awake for a duration referred to as a time period where the controller is maintained awake to perform extended shutdown functions, such that the controller may be awake during a refueling event. In another example, a wakeup capability may enable a circuit to wake the controller when refueling is underway.

Undesired evaporative emissions detection routines may be intermittently performed by controller 212 on fuel system 218 and/or evaporative emissions system 251 to confirm that undesired evaporative emissions are not present in the fuel system and/or evaporative emissions system. As such, evaporative emissions detection routines may be performed while the engine is off (engine-off test) using engine-off natural vacuum (EONV) generated due to a change in temperature and pressure at the fuel tank following engine shutdown and/or with vacuum supplemented from a vacuum pump. Alternatively, evaporative emissions detection routines may be performed while the engine is running by operating a vacuum pump and/or using engine intake manifold vacuum.

As discussed above, fuel tank 220 may hold a plurality of fuel blends. However, the introduction of diesel fuel into a tank of a vehicle that is not configured to run on diesel fuel (or vice versa) may result in a variety of issues. This is because of the difference between the volatility of diesel and gasoline. For example, the hydrocarbon chains in diesel mainly comprise of heavy ends (e.g., C8-C12) that evaporate slowly, while gasoline has hydrocarbon chains with light ends such as propane and butane that evaporate readily. As a result, engine parts (e.g. fuel injectors) may become clogged with the incorrect fuel and may not function as desired after introduction of diesel fuel into the tank. As another example, spontaneous ignition of the diesel fuel inside gasoline engine cylinders can cause engine component damage, necessitating expensive repair or replacement. Thus, it may be desirable to detect the presence of misfueling as early as possible during a refueling event.

Due to the high volatility rate of gasoline fuel, hybrid vehicles are usually equipped with carbon canister to adsorb the fuel vapor produced by the gasoline. Vapor adsorption is an exothermic reaction which results in an increase in canister temperature. Since diesel fuel is much less volatile than gasoline, during a refueling event with diesel, a smaller amount of fuel vapors are adsorbed in the carbon canister, resulting in a negligible exothermic reaction. Therefore, a temperature gain of the carbon canister during a refueling event may be advantageously used as an indication of misfueling. As will be discussed in FIGS. 3 and 6, by monitoring a temperature change within the carbon canister during a refueling event, it may be determined if diesel fuel is being added to a fuel tank in a vehicle configured to run on gasoline. Likewise, the temperature change may be utilized to indicate whether gasoline, or other fuel blend, is being added to a fuel tank in a vehicle configured to run on diesel fuel. In one example, the incorrect fuel may have a lower volatility than the desired fuel, such as when the desired fuel is gasoline and the incorrect fuel is diesel. A determination of misfueling may be accomplished by setting/adjusting a temperature threshold against which the temperature measured by one or more thermocouples within the carbon canister is assessed. The misfueling temperature threshold may be adjusted based on the expected temperature if the correct fuel (e.g., gasoline fuel) were being added to the fuel tank. In such an example, it may be indicated that diesel fuel is being added to the fuel tank instead of gasoline fuel when the actual temperature change is below the temperature threshold.

Figure 3:
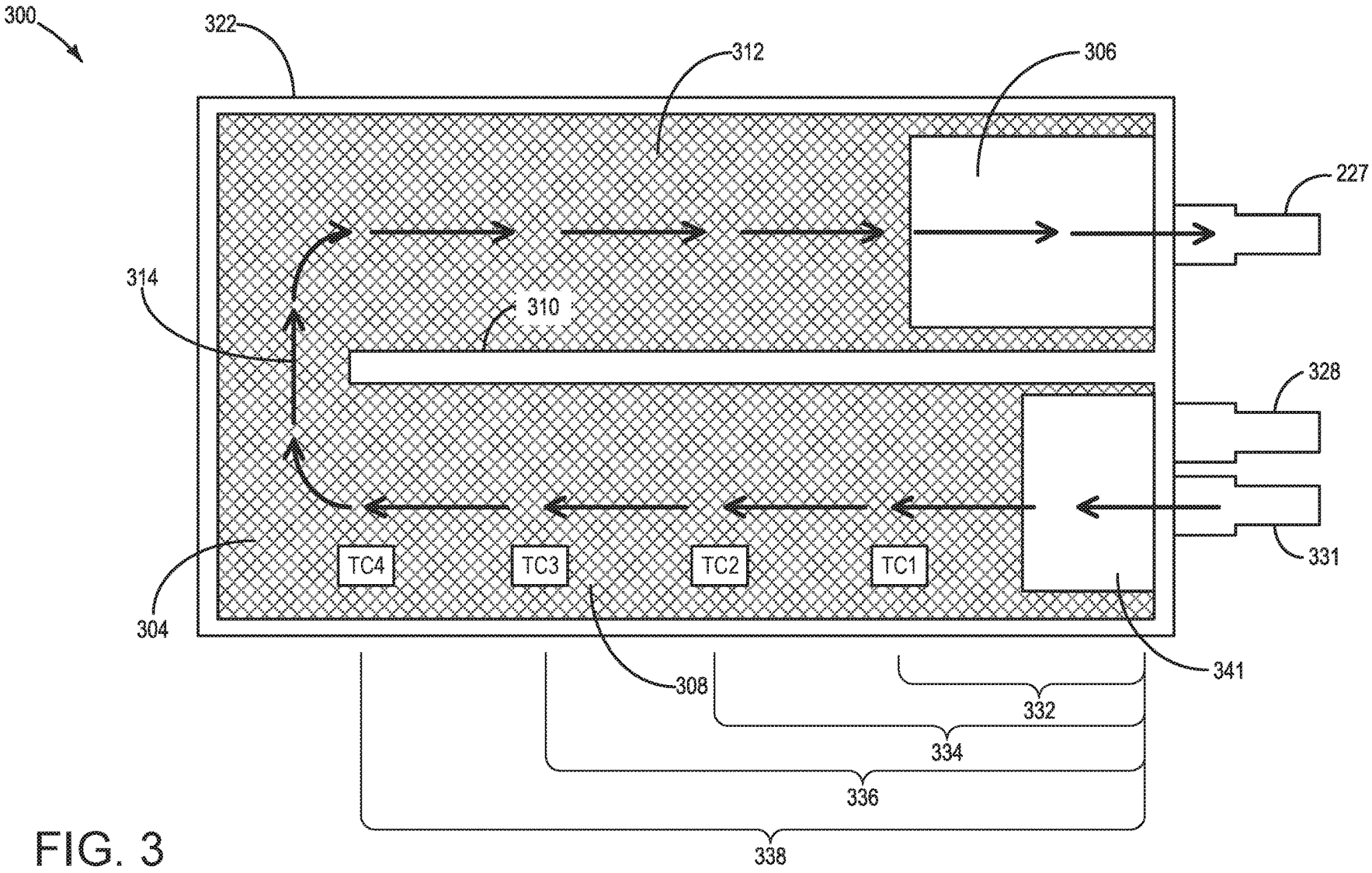
FIG. 3 shows an example carbon canister of the evaporative emission control system of FIG. 2, including one or more temperature sensors used to infer fuel level in a fuel tank.

Now turning to FIG. 3, an example carbon canister 300 including one or more temperature sensors used to infer a fuel level in a fuel tank is shown. In one example, canister 300 is the same as canister 222 of FIG. 2. Components previously introduced in FIG. 1-2 are numbered similarly and not reintroduced. Canister 300 includes an adsorbent 304, e.g., activated charcoal, which is used to adsorb fuel vapors from the fuel tank. For example, canister 300 may be coupled to fuel tank 220 via vapor recovery line 231. In one example, canister 300 may be put in communication with the atmosphere via vent line 227. Purge line 328 couples the canister to an intake of the engine (e.g. the intake system 223 of FIG. 2) for purging fuel vapor stored in the canister. In some examples, canister 300 may include a dividing element 310 which divides the interior of the canister into a first chamber 308 and a second chamber 312. The first chamber 308 and the second chamber 312 are coupled together such that vapors may enter the vapor inlet port 331 (also referred herein as vapor recovery line), which is in fluid communication with the fuel tank (e.g. fuel tank 220 in FIG. 2) through an FTIV which then allows vapors to flow from the first chamber 308 to second chamber 312 along a vapor path 314, and exits through the vent line 227, which opens to the ambient atmosphere.

Multiple thermocouples (TC1-TC4) are positioned along the vapor path 314 within the canister. In one example, the thermocouples may be equally spaced and positioned in the first chamber only. In another example, the thermocouples may be positioned in both, first and second chambers. Although only four thermocouples are shown, it is understood that more than four thermocouples may be employed in any position between the first and the second chamber. Further, the depicted distances of the thermocouples from the vapor inlet port 331 are merely exemplary, and may vary in different embodiments based on other factors such as size and capacity of the canister. For example, a first temperature sensor TC1 may be included at a first distance 332, a second temperature sensor TC2 may be included at a second distance 334 greater than first distance 332, a third temperature sensor TC3 may be included at a third distance 336 greater than second distance 334, a fourth temperature sensor TC4 may be included at a fourth distance 338 greater than third distance 336, etc., from vapor recovery line 331 within canister 300. In another example, the thermocouples may be positioned at increments of 15% partitions within the canister, such that the first distance 332 is at 15% partition mark from the vapor inlet, second distance 334 at 30%, and so on.

During vehicle refueling and canister purging, each thermocouple measures the interior temperature of the canister at its location. As the fuel tank is refueled, the carbon adsorbent within the canister adsorbs hydrocarbon vapors emerging from the tank and since vapor adsorption is an exothermic reaction, this results in an increase in the interior temperature of the canister 300. As an example, when a correct type of fuel is provided during a refueling event (e.g. gasoline), an initial temperature rise can be detected by TC1 at the beginning of the refueling event, and as the fuel level in the fuel tank increases, more vapors are produced, and the heat gain may be detected by the downstream thermocouples disposed within that region. For example, the increase in temperature may be initially detected by TC1, followed by TC2, TC3, and TC4, as more fuel is added into the fuel tank. As the carbon adsorbent within the region (e.g. first distance 332, second distance 334, etc.) adsorbs the hydrocarbon vapors, the temperature of the thermocouple disposed within that region rises (e.g. temperature rise is detected by TC1 as vapors flow to the first distance 332), until the adsorption reaches a maximum and the carbon adsorbent is saturated. A cooling effect may result as the fuel vapor continue to flows pass the saturated carbon adsorbent, leading to an initial decrease in temperature prior to reaching a temperature plateau (also referred herein as the inflection point) in the temperature curve within that region. In comparison, if an incorrect type of fuel is provided, less fuel vapor may be produced which then leads to less vapor adsorption in the canister and thus, less temperature gain may be observed. For example, the actual fuel (e.g. diesel) may have a lower volatility than the desired fuel (e.g., gasoline). Thus, by monitoring the temperature rise within the carbon canister and determining a rate of change in fuel level within the fuel tank (e.g. with fuel level sensor) over a predetermined period of time, a controller can identify if a correct fuel is provided during a refueling event.

The controller can also infer the amount of fuel added to the fuel tank based on the saturation level of the carbon canister. In one example, the fuel level in the fuel tank during the refueling event is inferred based on an output of the one or more thermocouples coupled inside the canister. For example, the carbon adsorbent near the vapor inlet region of the canister may experience an immediate heat gain when refueling begins such that a temperature increase may be detected by first temperature sensor TC1. As more fuel is dispensed into the fuel tank, more fuel vapors are produced and the adsorbent at the first distance from the vapor inlet region may be saturated and thus an inflection point may be observed. As more fuel vapors flow through the canister during refueling, thermocouples further downstream of the TC1 may experience heat gain up until the refueling ends. In this example, an increased amount of fuel added to the fuel tank may lead to a more downstream temperature sensor responding. Thus, by monitoring the number of downstream temperature sensors that detect a temperature change, the amount of fuel dispensed may be inferred. In addition, the initial vapor loading of the canister, e.g., the amount of fuel vapor (due to residual fuel in the fuel tank) stored in the canister prior to refueling, may also affect the number of downstream temperature sensors which are able to sense a temperature change. By not requiring a heat gain measurement to be linked to a particular downstream temperature sensor, the initial vapor loading of the canister may be taken into account for accurate fuel amount inference. To know the exact fuel level within the fuel tank, the amount of residual fuel in the fuel tank prior to refueling may be recorded by the vehicle controller, for example. Thus, by summing up the amount of fuel added to the tank during refueling and the amount of residual fuel in the tank prior to refueling, the level of fuel within the fuel tank may be accurately inferred.

Further, a fuel level in the fuel tank may also be inferred based on a cool down duration detected by the temperature sensors within the carbon canister. The cool down duration is defined as the time duration when an initial temperature decrease is sensed by a first temperature sensor within the carbon canister during refueling up until the inflection point where the temperature in the canister switches from decreasing to increasing for that particular temperature sensor. A relationship between the cool down duration and the amount of fuel added may be learned and stored in the controller memory. In one example, the cool down duration may be proportional to the amount of fuel dispensed into the fuel tank. For example, increasing an amount of fuel added to the tank may cause the cool down duration to increase. In some examples, a regression model, e.g., a linear fit data, may be used to determine the amount of fuel added to the fuel tank based on the length of the cool down time duration. Once the fuel amount is determined, the fuel level in the tank may then be inferred by summing up the amount of residual fuel to the amount of fuel added during the refueling event.

In this way, the components of FIGS. 1-3 enables a vehicle system comprising an engine, a fuel vapor canister coupled to a fuel tank; a plurality of canister temperature sensors coupled to a vapor flow path of the fuel vapor canister; and a fuel tank isolation valve coupled between the fuel vapor canister and the fuel tank. The vehicle system may further include a controller configured with computer-readable instructions for opening the fuel tank isolation valve to receive fuel in the fuel tank; monitoring a change in temperature of the fuel vapor canister via the sensors while receiving the fuel; indicating misfueling of the fuel tank based the monitored change in temperature being different from an expected change in temperature; and responsive to the indicating, closing the fuel tank isolation valve to disable receiving of the fuel in the fuel tank. The vehicle system may further comprise a filler neck for receiving fuel in the fuel tank, wherein the controller includes further instructions for: responsive to the indication of misfueling, actively locking the filler neck. In one example, the vehicle system is included in a hybrid electric vehicle, and the plurality of canister temperature sensors are spaced symmetrically or asymmetrically along the vapor flow path within the canister.

Figure 4:
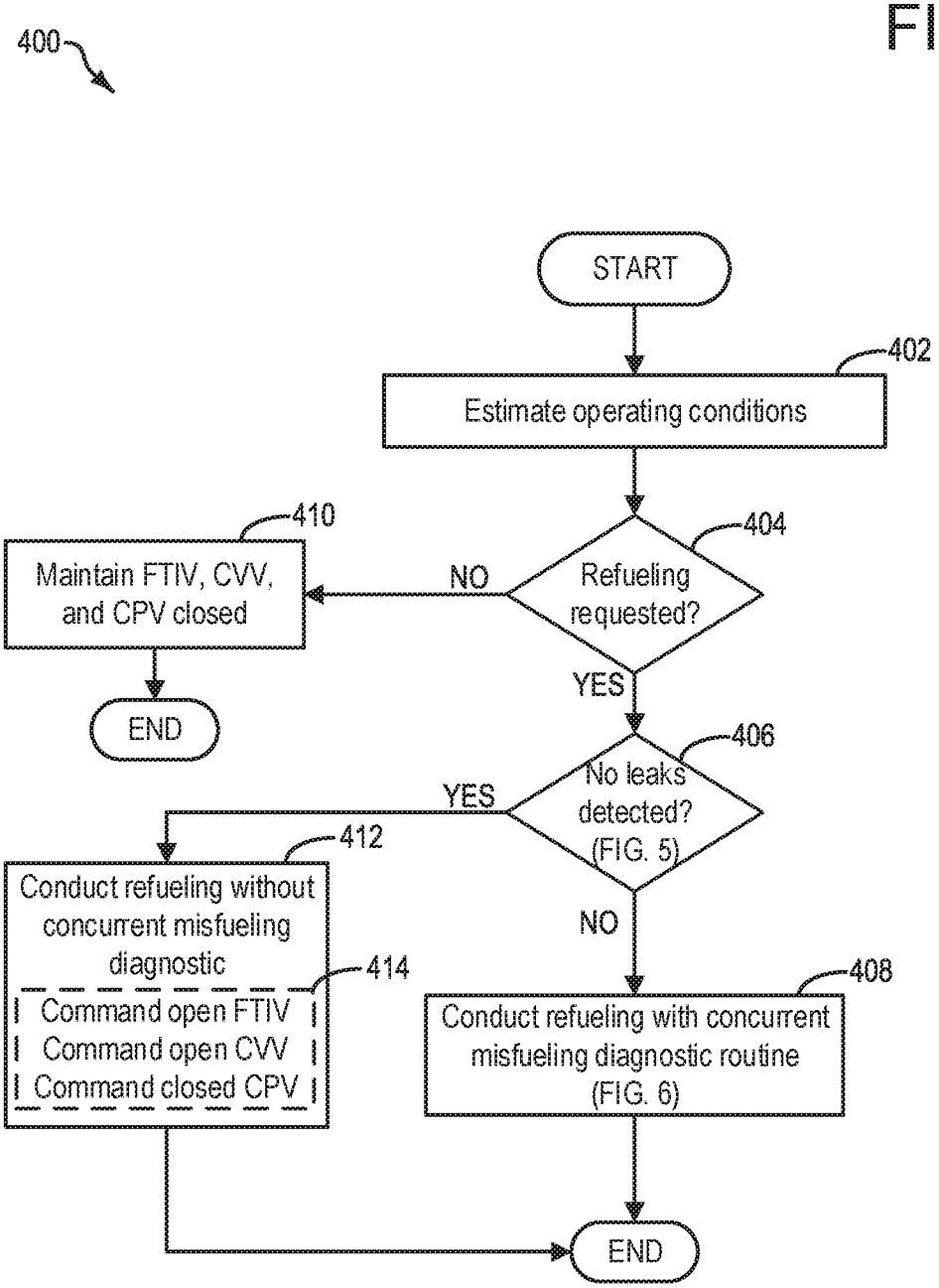
FIG. 4 shows a high-level flowchart illustrating an example routine for determining whether conditions are met for conducting misfueling diagnostic during refueling event.

Turning now to FIG. 4, a high level flowchart of an example method 400 for operating a fuel system during a refueling event is shown. More specifically, method 400 may be used to indicate whether a refueling event is requested, and if so, whether conditions are met for a misfueling diagnostic to be performed. Instructions for carrying out method 400 and the rest of the methods included herein may be executed by a controller, such as control system of FIG. 1 and controller 212 of FIG. 2, based on instructions stored on a memory of the controller and in conjunction with signals received from sensors of the engine system, such as the sensors described above with reference to FIGS. 1-3. The controller may employ fuel system and evaporative emission system actuators, such as fuel tank isolation valve (FTIV), canister vent valve (CVV), canister purge valve (CPV), etc., according to the methods described below.

At 402, the method includes estimating engine operating conditions. Operating conditions may be estimated, measured, and/or inferred, and may include one or more vehicle conditions, such as vehicle speed, vehicle locations, etc., various engine operating conditions, such as engine status (e.g., engine on or off), engine load, engine speed, air-to-fuel (A/F) ratio, etc., various fuel system conditions, such as fuel level, fuel type, fuel temperature, etc., various evaporative emissions system conditions, such as fuel vapor canister load, fuel tank pressure, etc., as well as various ambient conditions, such as ambient temperature, humidity, barometric pressure, etc.

Once the various operating conditions are estimated, at 404, it may be determined whether refueling is requested. For example, a refueling request may be confirmed responsive to a vehicle operator depression of a refueling button on a vehicle instrument panel in the vehicle (e.g., refueling button 197 of FIG. 1), or at a refueling door. In some examples, a refueling request may comprise a refueling operator requesting access to a fuel filler neck, for example, by attempting to open a refueling door, and/or attempting to remove a gas cap. Such examples are not meant to be limiting, and a refueling request may be indicated via any manner known in the art. If refueling is not requested, then the method proceeds to 410 where the FTIV, CVV, and CPV may be maintained closed. Method 400 may then end.

If a refuel request is confirmed, then method 400 proceeds to 406, where it may be determined if any leaks are detected in the evaporative emissions system and or the fuel system. In one example, the method may determine if there is any leak or undesired emission from the fuel system 218 or EVAP 251 of FIG. 2. An example evaporative emissions test procedure is illustrated in FIG. 5, which will be described in further detail below.

If a leak is detected, then at 412, refueling is conducted without concurrently running a misfueling diagnostic routine. Refueling without detecting misfueling includes, at 414, commanding FTIV and CVV open, while the CPV is maintained closed. In one example, responsive to a request for refueling, the FTIV and CVV may be commanded open to depressurize the fuel tank. Upon indication that the fuel tank is depressurized, a refueling lock may be commanded open, or may passively open, as discussed above, to allow the refueling operation to begin and the method ends. When a leak is detected during the evaporative emission test, not all of the fuel vapors produced by the fuel in the fuel tank will be contained within the evaporative emission system. As a result, the amount of heat detected due to the vapors adsorbed within the carbon canister may not be accurate.

Returning to 406, if no leak is detected, then the method proceeds to 408 where refueling is conducted while concurrently conducting misfueling diagnostic routine further elaborated at FIG. 6. During the refueling event, fuel level may be monitored via fuel level sensor (e.g., fuel level sensor 203 of FIG. 2). Alternatively, the fuel level may be inferred based on the output of the canister temperature sensors during the refueling.

Once the tank is filled to capacity, a fill level vent valve (FLVV), such as valve 285 of FIG. 2, may be closed, thus increasing pressure within the fuel tank such that an automatic refueling dispenser shutoff may be initiated. Alternatively, refueling may be stopped at any point by a refueling dispenser operator. As such, the refueling event may be indicated to be complete responsive to one or more of at least the refueling dispenser being removed from the fuel filler neck, a fuel level plateau for a predetermined duration of time, pressure in the fuel tank reaching atmospheric pressure for a predetermined amount of time, etc. When it is indicated that the refueling event is complete, FTIV may be commanded closed to seal the fuel tank, and the CVV may be maintained open.

It may be understood that the above-described example scenario for refueling a fuel tank is well known in the art, and as such, a separate example method is not included for brevity. Thus, it may be understood that any manner of conducting a refueling event on a vehicle, such as the vehicle system of FIGS. 1-2, may be performed without departing from the scope of this disclosure.

Now turning to FIG. 5, an example method 500 for determining the presence or absence of undesired evaporative emissions system in a vehicle fuel system and evaporative emissions system is shown. More specifically, method 500 may be used to conduct an evaporative emissions test on a vehicle fuel system and evaporative emissions system via the use of intake manifold vacuum to evacuate the fuel system and evaporative emissions system. Upon a vacuum build-up in the fuel system and evaporative emissions system reaching a threshold that is negative with respect to atmospheric pressure, the fuel system and evaporative emissions system may be sealed, and subsequent pressure bleed-up may be monitored. The fuel system and evaporative emissions system may be indicated to be free from undesired evaporative emissions if the pressure bleed up to below a threshold pressure, or if a rate of pressure bleed-up is below a predetermined pressure bleed-up rate, for example. If the fuel system and evaporative emissions system are indicated to be free from undesired evaporative emissions, then at a subsequent refueling event, a misfueling diagnostic may be conducted during the refueling event.

Method 500 will be described with reference to the systems described herein and shown in FIGS. 1-2, though it should be understood that similar methods may be applied to other systems without departing from the scope of this disclosure. Method 500 may be carried out by a controller, such as controller 212 in FIG. 2, and may be stored at the controller as executable instructions in non-transitory memory. In one example, the method of FIG. 5 is performed as part of the method of FIG. 4, such as step 402.

At 502, the method includes estimating current operating conditions. Current operating conditions may include one or more vehicle conditions, engine conditions, fuel system conditions, evaporative emissions system conditions, as detailed at 402 of FIG. 4.

Continuing at 504, it may be determined whether conditions are met for an evaporative emissions test. For example, at 510, evaporative emissions test conditions may be confirmed responsive to a threshold fuel level present in the fuel tank (e.g., a fuel level between 15% and 85% of the capacity of the fuel tank), ambient temperature above a threshold (e.g., at temperature between 40-95° F.), altitude less than a threshold (e.g., less than 8000 feet), fuel vapor level in canister below a threshold (e.g., negligible fuel vapors in the carbon canister), vehicle speed above a threshold (e.g., when vehicle is in a steady state speed condition), engine condition above a threshold (e.g., at a steady state load condition), engine coolant temperature (ECT) greater than a threshold (e.g., above 160° F.), intake manifold vacuum greater than a threshold manifold vacuum, etc. In some examples, all of the conditions listed above may need to be met in order to indicate that conditions are met for conducting the evaporative emissions test. In other examples, one or more of the conditions listed above may need to be met in order for the evaporative emissions test to be conducted.

If evaporative emissions test conditions are not met, method 500 may proceed to 530. At 530, the method includes maintaining the status of the vehicle fuel system and evaporative emission system. For example, components such as the FTIV, CVV, CPV, may be maintained at their current position and/or activity. For example, FTIV may be kept closed. Method 500 may then end.

Alternatively, if conditions for conducting the evaporative emissions test are met at 504, method 500 may proceed to 506. At 506, the CPV and the FTIV are commanded open, and the CVV is commanded closed. More specifically, control signal sent from the vehicle controller (e.g. controller 212 of FIG. 2) to the CPV commanding the CPV to an open position (e.g., fully open), another signal may be sent from the vehicle controller to the FTIV commanding the FTIV open (e.g., fully open), and yet another signal may be sent from the vehicle controller to the CVV commanding the CVV to close (e.g., fully closed). By commanding open the CPV, and further commanding open the FTIV, vacuum from the intake manifold may be applied to the vehicle fuel system and vehicle evaporative emissions system. With the CVV closed, the vacuum applied to the fuel system and evaporative emissions system may build, until a predetermined negative pressure threshold is reached. In some examples, a vehicle may not include a FTIV. In such an example, the CPV may be commanded open and the CVV may be commanded closed, such that intake manifold vacuum may be applied to the fuel system and evaporative emissions system, as discussed.

At 508, the method includes monitoring pressure in the fuel system and evaporative emissions system while vacuum from the intake manifold is applied to the fuel system and evaporative emissions system. Pressure may be monitored, for example, via one or more fuel tank pressure sensor(s) (e.g. sensor 291 of FIG. 2).

Continuing to 510, it may be determined whether pressure in the fuel system and evaporative emissions system is below a predetermined pressure threshold. In other words, it may be detected if sufficient vacuum has built in the fuel system. If, at 510, it is indicated that pressure in the fuel system and evaporative emissions system is above the pressure threshold, the method may proceed to 532. At 532, it may be determined whether a pressure plateau has been reached during the evacuating of the fuel system and evaporative emissions system. In one example, a pressure plateau may be indicated if pressure in the fuel system and evaporative emissions system reaches a level that is above (e.g., positive with respect to) the pressure threshold, and remains at or around that pressure for a predetermined duration. If a pressure plateau is not indicated, the method returns to 508 where the pressure in the fuel system and evaporative emission system is continued to be monitored, while intake manifold vacuum continues to be applied. Otherwise, if the pressure has reached a plateau, then the method proceeds to 540.

At 540, the method includes indicating the presence of undesired evaporative emissions. For example, because intake manifold vacuum was applied to the fuel system and evaporative emissions system, and because the vacuum was unable to reduce pressure in the fuel system and evaporative emissions system to the predetermined negative pressure threshold, it is inferred that undesired evaporative emissions may be present, stemming from a leak in the fuel system and/or evaporative emissions system. Thus, at 540, undesired evaporative emissions may be indicated, and such a result may be stored at the controller, for example.

Responsive to the indication of the presence of undesired evaporative emissions, the method may then proceed to 520. At 520, the CPV and FTIV are commanded closed, and the CVV is commanded open. In cases where the vehicle does not include a FTIV, only the CVV may be commanded open, and the CPV commanded closed. In one example, after closing the CPV, the CVV may next be commanded open, thus allowing pressure in the fuel system and evaporative emissions system to return to atmospheric pressure, prior to commanding the FTIV closed.

At 522, the status of the fuel system and evaporative emissions system is updated. For example, when a leak in evaporative emissions is detected, an indication may be provided to the vehicle operator, such as illuminating a malfunction indicator light (MIL) on the vehicle dash, and thus alerting the operator to the need to service the vehicle. Furthermore, at 522, updating the status of the fuel system and evaporative emissions system may include indicating that conditions are not met for conducting a misfueling diagnostic during a subsequent refueling event. Such an indication may be stored in the vehicle controller, for example, as a flag. Method 500 may then end.

Returning to 510, if pressure in the fuel system and evaporative emissions system is above a pressure threshold, method 500 may proceed to 512. At 512, the fuel system and evaporative emissions system are sealed. Sealing the fuel system and evaporative emissions system may include commanding closed the CPV, and commanding closed the CVV, for example, and if included, the FTIV may be maintained open. By maintaining the FTIV open, with the CVV and CPV closed, the fuel system may be in fluid communication with the evaporative emissions system, where both the fuel system and evaporative emissions system are sealed from atmosphere. As discussed above, commanding the CPV and CVV closed may include the controller sending signals to actuators coupled to the valve to move them to a fully closed position.

Proceeding to 514, the method includes monitoring pressure in the fuel system and evaporative emissions system. As discussed above, monitoring pressure in the fuel system and evaporative emissions system may be conducted via one or more fuel tank pressure transducer(s) (e.g., FTPT 291 of FIG. 2). In one example, the pressure may be monitored for a predetermined duration. The predetermined duration may be a time duration, wherein in the absence of evaporation emission system leak, pressure may be expected to remain below a predetermined pressure threshold. Next, at 516, it may be determined whether pressure bleed-up in the fuel system and evaporative emissions system is above a predetermined bleed-up pressure threshold. Additionally or alternatively, it may also be determined if the pressure bleed-up rate in the fuel system and evaporative emissions system is above a predetermined pressure bleed-up threshold rate. For example, the predetermined bleed-up pressure threshold may be related to an orifice size at which undesired evaporative emissions may be escaping from the fuel system and evaporative emissions system. For example, if the pressure bleed-up threshold is reached subsequent to sealing the fuel system and evaporative emissions system at step 512, then it may be indicated that a leak in the evaporation emission system may be present.

If pressure bleed up is indicated to a greater than a pressure threshold, or if a pressure bleed-up rate is greater than the predetermined pressure bleed-up threshold rate, then method 500 may proceed to 540 where the presence of undesired evaporative emissions (e.g. a leak) is indicated. Such an indication may be stored at the controller, for example. In response to the undesired evaporative emission, at 520, the CPV and FTIV are commanded closed, and the CVV is commanded open. At 522, the status of the fuel system and evaporative emissions system are updated and it may be indicated that conditions are not met for conducting a misfueling diagnostic during a subsequent refueling event. Method 500 may then end.

Returning to 516, if pressure bleed-up, as monitored in the vehicle fuel system and evaporative emissions system, remains below (e.g. negative with respect to) the predetermined bleed-up pressure threshold, or if the pressure bleed-up rate is indicated to be lower than the predetermined pressure bleed-up threshold rate, then method 500 may proceed to 518. At 518, method 500 includes indicating an absence of undesired evaporative emissions stemming from the fuel system and evaporative emissions system. In one example, the controller may indicate that the fuel and evaporative emissions system is leak-free. Such an indication may be stored at the controller, for example. Responsive to indicating the absence of undesired evaporative emissions, method 500 may proceed to 520 to close the CPV and FTIV, while opening the CVV. At 522, fuel system and evaporative emissions system status is updated. For example, updating fuel system and evaporative emissions system status may include indicating that conditions are met for a misfueling diagnostic to be performed at a subsequent refueling event. Such an indication may be stored at the controller, in an example, as a flag. Method 500 may then end.

While an evaporative emissions test diagnostic procedure discussed at FIG. 5 includes an engine-on condition where the fuel system and evaporative emissions system are evacuated via engine intake manifold vacuum, such an example is illustrative and not meant to be limiting. For example, any method known in the art may be utilized to determine the presence or absence of undesired evaporative emissions at step 406 of FIG. 4. For brevity, all potential options for conducting evaporative emissions test diagnostics are not reiterated herein. However, such examples may include the use of an on-board pump to pressurize or evacuate the fuel system and evaporative emissions system, such that an assessment of the presence or absence of undesired evaporative emissions may be determined. In another example, responsive to an engine-off event, engine-off natural vacuum (EONV) techniques may be utilized to pressurize and/or evacuate the vehicle fuel system and evaporative emissions system, such that an assessment of the presence or absence of undesired evaporative emissions may be determined. Briefly, for an EONV test, a fuel system (and in some examples an evaporative emissions system) may be isolated at an engine-off event. The pressure in such a fuel system (and evaporative emissions system) may increase if the tank is heated further (e.g., from hot exhaust or a hot parking surface) as liquid fuel vaporizes. Pressure increase above a positive pressure threshold may indicate the absence of undesired evaporative emissions. Alternatively, if the positive pressure threshold is not reached, as the fuel tank cools down, a vacuum may be generated therein as fuel vapors condense to liquid fuel. In such an example, vacuum generation may be monitored and undesired evaporative emissions may be identified based on expected vacuum development or expected rates of vacuum development. In any case, an absence of undesired evaporative emissions in the vehicle fuel system and evaporative emissions system may thus represent a condition where a misfueling diagnostic may be conducted.

Referring now to FIG. 6, a high-level example method 600 for conducting a refueling operation and corresponding misfueling diagnostic test, is shown. More specifically, method 600 may be conducted during a refueling operation to determine whether an incorrect type of fuel is being added to the fuel tank. In one example, the method of FIG. 6 is performed as part of the method of FIG. 4, such as at 408.

At 602, the method includes depressurizing the fuel tank responsive to an indication that a refueling event is requested, and further responsive to an indication that conditions are met for conducting a misfueling test diagnostic. Responsive to a signal to depressurize fuel tank, at 604, the controller may command the FTIV and CVV to open and the CPV to close in order to maintain a vent path open between the fuel vapor canister and atmosphere. Thus, it may be understood that the FTIV may control a flow of air and fuel vapor in a conduit coupling the fuel tank to the fuel vapor storage canister, and the CVV may control flow of air and fuel vapor in a vent line coupling the fuel vapor storage canister to atmosphere. The FTIV may be opened in a manner to depressurize the fuel tank at a predetermined rate, so as to prevent rapid depressurization. For example, FLVV and GVV may close shut responsive to rapid depressurization. By commanding open the FTIV, the fuel tank may be selectively coupled to adsorbent material contained in a fuel vapor canister positioned in an evaporative emissions system of the vehicle. A refueling lock may be maintained locked until the fuel tank pressure decreases to a threshold pressure (e.g., atmospheric pressure), and then commanded to unlock, thus allowing access to the fuel filler neck only following fuel tank depressurization. In some examples, the refueling lock may be commanded to unlock via the controller sending a signal to the refueling lock, thus actuating open the refueling lock. In another example, the refueling lock may be opened via mechanical means, responsive to fuel tank depressurization.

In engine systems that do not include an FTIV, the CVV may be maintained open, except for during leak test routines to identify the presence or absence of undesired evaporative emissions. Thus, in an example where a vehicle is not equipped with an FTIV, the fuel tank may typically be at or near atmospheric pressure, and thus a depressurization procedure prior to refueling may not be required.

At 606, a fuel level is monitored while fuel is received during refueling. In one example, fuel level in the fuel tank may be monitored via fuel level sensor coupled to the fuel tank (e.g. fuel level sensor 203 of FIG. 2). Monitoring fuel level may include sending an updated fuel level to a memory component included in a controller in a vehicle, such that a fuel level display in the vehicle may be updated. For example, it may be indicated that the fuel level is at 50% when half of the fuel tank is filled with fuel.

At 608, a fuel dispense rate is calculated and an expected temperature threshold is adjusted based on the fuel level in the fuel tank. In one example, fuel dispense rate may be calculated based on the rate of change in the fuel level in the tank, detected via the fuel level sensor, over a predetermined time period, multiplied by fuel tank capacity (in gallons), as represented by the following equation:

$$\text{fuel dispense rate} = \frac{d(\text{Fuel level})}{dt} \times \text{fuel tank capacity}$$

where the fuel capacity may be programmed into the vehicle controller memory, for example. By determining a fuel dispense rate, an expected temperature within the carbon canister may be adjusted as a function of fuel dispense rate, the expected temperature increasing as the dispense rate increases. In addition, the expected temperature may be determined as a function of the expected fuel's volatility. Since the expected temperature increase within the carbon canister may vary depending on the ambient temperature, a controller may be configured to further adjust the expected temperature increase based on the ambient temperature. For example, the controller may determine a fuel level in the fuel tank over a predetermined duration of a refueling event. In one example, the fuel level within the fuel tank may be determined via a fuel level sensor and the base temperature within the carbon canister may be determined via a thermocouple measurement prior to a refueling event. Once the refueling event commences, the fuel level and temperature increase may be measured every 30 seconds, for example. In this way, at every 30 seconds, the increase in the fuel level in the fuel tank (also referred to as the fuel dispense rate) may be correlated to temperature gain within the carbon canister and this information may be learned and updated into the controller's memory. Further, the information containing the relationship between fuel dispense rate and expected temperature threshold may be stored in a lookup table in the vehicle controller. For example, the lookup table may comprise of fuel dispense rate, ambient temperature, and an expected temperature increase within the carbon canister based on the fuel dispense rate and ambient temperature.

In one example, the expected temperature profile may include an expected temperature gain and an expected inflection point for each of the one or more thermocouples as a function of time since a start of the refueling event. The expected temperature gain and expected inflection point for each of the one or more thermocouples may be further based on a position of the one or more thermocouples within the canister relative to a vapor inlet and/or outlet of the canister. For example a time of a peak temperature gain may be earlier during the refueling event for a thermocouple positioned closer to the vapor inlet while a timing of the peak temperature gain may be later during the refueling event for a thermocouple positioned closer to the vapor outlet. Further, the expected temperature profile may be based on a volatility of the fuel. In one example, the expected temperature profile measured based on the fuel level in the fuel tank may include, as the fuel level in the fuel tank increases during the refueling event, increasing the temperature gain.

At 610, a temperature change in the canister is determined based on input from one or more thermocouples coupled to carbon canister. For example, the temperature change in the canister may be based on the cool down duration on a single thermocouple coupled to the canister. The cool down duration may be a time duration from an initial temperature decrease in the canister during refueling until an inflection point where the temperature in the canister switches from decreasing to increasing. In another example, the temperature change may be based on a plurality of thermocouples coupled to the carbon canister at various depths. In this case, the temperature change may be a temperature change during a duration from an initial rise in temperature at a first thermocouple in the canister to an inflection point in temperature at a second thermocouple in the canister, where the second thermocouple is positioned downstream of the first thermocouple.

For example, the actual temperature profile may be estimated via one or more thermocouples spaced along a vapor flow path within the carbon canister and the actual temperature profile may be compared with an expected temperature profile where the expected temperature profile may include an expected temperature gain and an expected inflection point for each of the one or more thermocouples as a function of time since a start of the refueling event.

At 612, it may be determined whether the temperature change is below a threshold. In particular, the temperature change of each temperature sensor or thermocouple of the canister may be compared to the respective threshold (e.g., a temperature change or profile at a first canister temperature sensor may be compared to a first threshold while a temperature change or profile at a second canister temperature sensor, positioned downstream or upstream of the first sensor, may be compared to a second threshold, different from the first threshold). In one example, the distinct threshold for each of the plurality of temperature sensors may be adjusted based on a fuel level in the fuel tank, an ambient temperature, and a position of each of the plurality of temperature sensors along the vapor flow path. If the temperature change is below the corresponding threshold, then the method proceeds to step 622 where it may be indicated that an incorrect fuel is added into the tank. In one example, misfueling may be indicated responsive to the temperature change at each of the canister temperature sensors being lower than their corresponding thresholds. In an alternate example, misfueling may be indicated responsive to the temperature change of at least one (or a threshold number) of the canister temperature sensors being lower than their corresponding thresholds.

Indicating misfueling may include providing a display message to alert the vehicle operator that a misfueling event has occurred. In another example, alerting vehicle operator of misfueling may include illuminating indicator light (MIL) on the dash. Further, at 624, FTIV is commanded closed to seal the fuel tank from the atmosphere. In cases where FTIV is not present, then CVV may be commanded closed. By sealing the fuel tank from atmosphere while fuel is being dispersed into the fuel tank, pressure within the fuel tank may rapidly build up, which may trigger a shutoff of the refueling dispenser such that additional fuel may be prevented from being added into the fuel tank. In this way, further addition of fuel during a refueling event is disabled by raising a pressure in a filler neck configured to receive fuel from a fuel dispenser by closing one or more of a fuel tank isolation valve coupling the fuel tank to the canister and a vent valve coupling the canister to atmosphere.

At 628, the incorrect type of fuel in the fuel tank may be discarded. For example, the incorrect fuel may be discarded by a fuel discarding device built into the fuel tank for releasing fuel into the atmosphere. The fuel discarding device (e.g., a valve or spout) may be operated by the vehicle operator through depression of a button, for example. Once the fuel tank has been emptied through the fuel discarding device, the method then ends.

Returning to 612, if the temperature change is above a temperature threshold, then the method proceeds to 614 where it may be indicated that correct fuel was added to the tank. For example, in vehicle configured for gasoline, it may be indicated that gasoline was added to the fuel tank. Since a correct fuel is being added to the tank, no further action is taken during the refueling event.

At 616, it may be determined if the refueling event has been completed. In one example, refueling is considered to be completed when fuel level in the fuel tank has reached a plateau for a predetermined amount of time, as detected via a fuel level sensor. In another example, refueling may be indicated as complete based on an indication that a refueling nozzle has been removed from the fuel filler neck, based on an indication that a fuel cap has been replaced, or when a refueling door has been closed.

At 618, the FTIV may be commanded closed to seal the fuel tank from atmosphere. By sealing the fuel tank from atmosphere, pressure within the fuel tank may rapidly build up, which may trigger a shut-off of the refueling dispenser and stop the refueling event. At 620, fuel system and evaporative emission system status may be updated. For example, fuel level in the fuel tank may be updated and displayed on the vehicle dash, responsive to the recent refueling event. Method 600 may then end.

In this way, by monitoring a temperature change at each of a plurality of temperature sensors spaced along a vapor flow path within the carbon canister while receiving fuel in a fuel tank, a controller may detect misfueling based on the temperature change at any one of the plurality of temperature sensors relative to a threshold. When the temperature change is higher than a corresponding threshold (that is, when the actual temperature change at a given canister temperature is sensor is higher than a threshold for that sensor), a valve coupling the fuel tank to the canister (e.g. FTIV) may be maintained open so that receipt of the fuel in the fuel tank may be continued. In contrast, when the temperature change is lower than the corresponding threshold, the valve coupling fuel tank to the canister may be closed such that further fuel receipt into the fuel tank may be discontinued and an incorrect fuel type may be indicated.

Now turning to FIG. 7, an example temperature profile within the carbon canister during a refueling event is shown. Plot 702 depicts fuel level in the fuel tank during a refueling event. Plot 701 depicts an example temperature profile in the carbon canister when a correct fuel is provided (e.g., gasoline). Plots 703 and 705 show examples of temperature profiles in the carbon canister when an incorrect fuel is provided. All plots are depicted over time along the x-axis. Time markers t1-t4 depict time points of significance during engine operation.

At t1, a refueling event is initiated. When a correct fuel is provided (herein gasoline), as shown in plot 701, as the fuel level increases in the fuel tank (plot 702), the fuel vapor flows into the carbon canister and is adsorbed by the carbon adsorbent in the first region nearest to the inlet port of the canister (e.g. port inlet 331 of FIG. 3). The first thermocouple TC1 in the first region of the canister then detects an increase in temperature above the threshold 712 due to the exothermic reaction occurring during vapor adsorption by the carbon adsorbent. Once the carbon adsorbent within the first region reaches its saturation point, TC1 senses a temperature inflection at P and the temperature increase detected by TC1 reaches a plateau. At t2, the fuel vapor flows to the second region within the carbon canister, where the second region is further downstream of the first region. TC2 within the second region that detects a temperature gain as the fuel vapor is adsorbed by the carbon canister and the temperature increase within the second region increases above the threshold 712. Similar to TC1, once the carbon adsorbent within the second region reaches its saturation point, the temperature gain detected by TC2 reaches an inflection point at P and begins to plateau thereafter. As fuel level increases in the fuel tank, more fuel vapor is produced, and the fuel vapor then flows to the third and then the fourth region within the carbon canister, where the third region is further downstream of the second region and the fourth region is further downstream of the third region. At t3, TC3 detects a temperature increase as the fuel vapor is adsorbed by the third region and reaches inflection point P before reaching a plateau. Similarly, at t4, TC4, detects a temperature increase in the fourth region and reaches the inflection point P as refueling ends. Thus, when a correct fuel is provided, temperature increase above threshold 712 can be sequentially detected by all thermocouples TC1-TC4 during a refueling event.

However, if an incorrect fuel is provided during a refueling event, depending on whether there is residual fuel in the fuel tank during refueling, the temperature profile in the carbon canister may be different. Incorrect fuel, such as diesel fuel in this example, typically comprises of heavy hydrocarbon chains, which does not evaporate readily. Thus, less fuel vapor is usually produced during a refueling event, which leads to less fuel vapor adsorption in the carbon canister and less temperature gain detected by the thermocouples.

It will be appreciated that in some cases, observing a temperature gain by the temperature sensors (e.g., TC2-TC4) downstream of the first temperature sensor nearest to the carbon canister vapor inlet (e.g., TC1) may provide a more accurate indication of the type of fuel being added (e.g., if correct type of fuel such as gasoline or an incorrect type of fuel such as diesel is provided). Due to the proximity of the first temperature sensor TC1 to the loading port of the canister (that is, vapor inlet of the canister), the carbon adsorbent in this region may be partially saturated with existing fuel vapor in the fuel system. As a result, even if a correct type of fuel is provided, the temperature gain observed in TC1 may be muted. Thus, in one example, a controller may indicate misfueling based on the presence or absence of temperature gain detected by one or more downstream temperature sensors in the canister, downstream of a first temperature sensor at the vapor inlet of the canister (such as downstream of TC1).

For example, the controller may indicate that the fuel received in the fuel tank is an incorrect fuel responsive to a weighted temperature change at the temperature sensors in the canister. Therein, the temperature change of a first of the plurality of temperature sensors located more downstream of a canister vapor inlet (e.g., TC3) may be weighted higher than the temperature change of a second of the plurality of temperature sensors located less downstream of the canister vapor inlet (e.g., TC1).

In plot 703, a temperature profile is shown when misfueling occurs to an empty fuel tank. At t1, as the refueling event begins, little to no vapor is produced due to misfueling and therefore the temperature increase detected by TC1 does not goes above the threshold 722. Similarly, due to a lack of fuel vapor being produced during misfueling, little to no temperature gain is detected by thermocouples TC2-TC4, downstream of TC1. Thus, responsive to a lack of temperature gain above threshold 722, misfueling may be identified.

Plot 705 depicts a temperature profile when an incorrect fuel (e.g. diesel) is provided to a fuel tank with residual hot fuel where the residual hot fuel is the correct fuel type (e.g. gasoline). At t1, when an incorrect fuel is dispensed into the fuel tank, some vapors from the residual hot fuel may be produced and get adsorbed by the carbon canister. Thus, a temperature increase is detected by TC1 with an inflection point above threshold 732. However, as more diesel fuel is added, less and less fuel vapor is produced, and therefore little to no temperature gain is detected by the thermocouples TC2-TC4 further downstream of TC1. Thus, the temperature gains detected by TC2-TC4 are below threshold 732 and the controller may determine that an incorrect fuel is being added to the fuel tank.

It is to be understood that threshold 722 in plot 703 may be different than threshold 712 in plot 701 or threshold 732 in plot 705. As discussed previously, the temperature threshold may be adjusted as a function of fuel dispense rate. Thus, the temperature thresholds 712, 722, and 732 may vary depending on the fuel dispense rate at a particular refueling station. In addition, the threshold may vary with ambient conditions, such as ambient temperature.

Now referring to FIG. 8, an example timeline map 800 is shown for conducting a refueling event and a concurrent misfueling test. Map 800 depicts refueling request at plot 802, leak test (also referred herein as volatility test) conditions at 806, fuel level indicator (FLI) at plot 810, canister temperature at plot 816, FTIV status at plot 825, CVV status at plot 830, CPV status at plot 832, fuel dispense rate at plot 836, and misfueling detection at plot 840. All plots are depicted over time along the x-axis. Time markers t1-t4 depict time points of significance during engine operation.

At t0, the vehicle stops at a gas station, with the intent to refuel the vehicle. However, at t0, refueling is not yet requested, indicated by plot 802. As refueling is not requested, test conditions for conducting a misfueling test diagnostic are not indicated to be met, illustrated by plot 806. Thus, misfueling is not indicated, illustrated by plot 840, and fuel dispense rate of a fuel dispenser nozzle, is indicated to be disabled (plot 836). Fuel level in the vehicle fuel tank is indicated to be near empty, illustrated by plot 810. Furthermore, the FTIV and CPV are closed, and the CVV is open, indicated by plots 825, 832, and 830, respectively.

At t1, a request for refueling is indicated as show by plot 802. For example, a request for refueling may include a vehicle operator depressing a refueling button on a vehicle instrument panel in the vehicle or at a refueling door. In another example, a refueling request may comprise a refueling operator requesting access to a fuel filler neck, for example, by attempting to open a refueling door, and/or attempting to remove a gas cap, etc. Responsive to a request for refueling, a volatility test is conducted to ensure that the evaporative emission system as well as the fuel system are leak-free. Plot 806 shows that the volatility test condition is met and no leaks are detected. Since no leaks are detected, refueling is conducted with concurrent misfueling diagnostic routine. Refueling is initiated by commanding FTIV to open (plot 825), and CVV is maintained opened while CPV is maintained closed. With the FTIV commanded open, pressure in the fuel tank stabilizes to atmospheric pressure between t1 and t2.

With the fuel tank depressurized at t2, refueling is commenced, represented by plot 836, and fuel level in the fuel tank starts to increase over time as shown by plot 810. As fuel level increases, if a correct fuel is provided, the canister temperature should increase to above a threshold 816 (as shown in plot 812). However, due to an incorrect fuel being dispensed, little to no temperature increase is detected by the thermocouple positioned within the carbon canister, and thus the temperature gain detected does not reach a threshold, as shown by plot 814. In response to a lack of temperature gain above a threshold, the controller may indicate that misfueling has occurred (plot 840), responsive to the indication of misfueling, at t3, FTIV is commanded closed. With FTIV closed, a pressure is built-up within the fuel tank and responsive to an increase in fuel tank pressure above a threshold, the fuel dispenser may be triggered to shut-off and therefore the fuel dispense rate may be dropped (plot 836).

In contrast, if a correct fuel (e.g., diesel fuel) is provided, the refueling may proceed after t3 since no misfueling is detected (plot 838). At t4, it may be indicated that the fuel level in the tank reaches a maximum (plot 810). As the fuel tank is indicated to be full, the refueling request is ceased (plot 804) and the volatility test may be suspended (plot 808). FTIV may then be commanded closed (plot 805) such that no more fuel may be dispensed and the fuel dispense rate returns to zero (plot 834) and it may be indicated that the refueling is completed.

In this way, misfueling may be identified when an increase in carbon canister above a threshold is not detected over a predetermined amount of time. In addition, further fueling is disabled once misfueling is detected by commanding an FTIV to close and sealing off the fuel tank. The technical effect of monitoring carbon canister temperature during a refueling event is that the temperature changes in the fuel vapor canister during refueling may be correlated with the presence of an incorrect fuel (e.g., a fuel having a different volatility than the expected fuel) in the fuel. By indicating that misfueling occurred during refueling event, mitigating action may be taken prior to starting the engine after refueling the vehicle. As a result, costly engine repairs due to misfueling may be avoided. Further, temperature changes within the carbon canister may also be utilized as a secondary source for fuel level monitoring when a correct fuel is provided.

One example method comprises: responsive to misfueling of a fuel tank identified based on an actual temperature profile at a fuel system canister during a refueling event relative to an expected temperature profile, the expected temperature profile based on a fuel level in the fuel tank, disabling further addition of fuel during the refueling event. In the preceding example, additionally or optionally, disabling further addition of fuel during the refueling event includes raising a pressure in a filler neck configured to receive fuel from a fuel dispenser by closing one or more of a fuel tank isolation valve coupling the fuel tank to the canister and a vent valve coupling the canister to atmosphere. In any or all of the preceding examples, additionally or optionally, indicating misfueling includes indicating that an actual fuel being received in the fuel tank is different from a desired fuel. In any or all of the preceding examples, additionally or optionally, the actual fuel has a lower volatility than the desired fuel. In any or all of the preceding examples, additionally or optionally, the actual temperature profile is estimated via one or more thermocouples spaced along a vapor flow path within the carbon canister. In any or all of the preceding examples, additionally or optionally, the fuel level in the fuel tank during the refueling event is inferred based on an output of the one or more thermocouples. In any or all of the preceding examples, additionally or optionally, the expected temperature profile includes an expected temperature gain and an expected inflection point for each of the one or more thermocouples as a function of time since a start of the refueling event, the expected temperature profile further based on a volatility of the fuel. In any or all of the preceding examples, additionally or optionally, the expected temperature profile based on the fuel level in the fuel tank includes, as the fuel level in the fuel tank increases during the refueling event, increasing the expected temperature gain. In any or all of the preceding examples, additionally or optionally, the expected temperature gain and expected inflection point for each of the one or more thermocouples is further based on a position of the one or more thermocouples within the canister relative to a vapor inlet and a vapor outlet of the canister. In any or all of the preceding examples, additionally or optionally, the indicating includes indicating misfueling responsive to an actual temperature gain of the actual temperature profile being lower than the expected temperature gain of the expected temperature profile. In any or all of the preceding examples, additionally or optionally, the indicating further includes indicating misfueling responsive to an actual inflection point of the actual temperature profile being earlier than the expected inflection point of the expected temperature profile. In any or all of the preceding examples, additionally or optionally, the fuel tank is coupled to an engine of a hybrid electric vehicle, and wherein the one or more thermocouples are spaced symmetrically or asymmetrically along the vapor flow path within the canister.

Another example method comprises: while receiving fuel in a fuel tank, monitoring a temperature change at each of a plurality of temperature sensors spaced along a vapor flow path within the carbon canister; responsive to the temperature changes at each of the plurality of temperature sensors being higher than a corresponding threshold, continuing to receive the fuel in the fuel tank by maintaining a valve coupling the fuel tank to the canister open; and responsive to the temperature change at any one of the plurality of temperature sensors being lower than the corresponding threshold, discontinuing further receipt of the fuel in the fuel tank by closing the valve, and indicating that the fuel is an incorrect fuel. In the preceding example, additionally or optionally, the corresponding threshold includes a distinct threshold for each of plurality of temperature sensors, and wherein the corresponding threshold is adjusted based on a fuel level in the fuel tank, an ambient temperature, and a position of each of the plurality of temperature sensors along the vapor flow path. In any or all of the preceding examples, additionally or optionally, the corresponding threshold is increased as the fuel level in the fuel tank increases, as the ambient temperature increases, and as the position approaches a vapor inlet of the canister. In any or all of the preceding examples, additionally or optionally, indicating the that fuel is an incorrect fuel responsive to the temperature change includes indicating responsive to a weighted temperature change, wherein the temperature change of a first of the plurality of temperature sensors located more downstream of a canister vapor inlet is weighted higher than the temperature change of a second of the plurality of temperature sensors located less downstream of the canister vapor inlet. In any or all of the preceding examples, additionally or optionally, indicating that the fuel is an incorrect fuel includes indicating that the fuel received in the fuel tank has a lower volatility than a desired fuel. In any or all of the preceding examples, additionally or optionally, discontinuing further receipt of the fuel in the fuel tank further includes raising a pressure at a filler neck configured to receive fuel in the fuel tank from a fuel dispenser by closing the valve, and actively locking the filler neck.

An example vehicle system comprises: a fuel vapor canister coupled to a fuel tank; a plurality of canister temperature sensors coupled to a vapor flow path of the fuel vapor canister; a fuel tank isolation valve coupled between the fuel vapor canister and the fuel tank; and a controller configured with computer-readable instructions for: opening the fuel tank isolation valve to receive fuel in the fuel tank; monitoring a change in temperature of the fuel vapor canister via the sensors while receiving the fuel; indicating misfueling of the fuel tank based the monitored change in temperature being different from an expected change in temperature; and responsive to the indicating, closing the fuel tank isolation valve to disable receiving of the fuel in the fuel tank. In the preceding example, additionally or optionally, monitoring the change in temperature of the fuel vapor canister via the sensors includes monitoring a temperature gain at each of the plurality of canister temperature sensors; and wherein the expected change in temperature includes an expected temperature gain for each of the plurality of canister temperature sensors as a function of time since a start of the refueling event, fuel level in the fuel tank, and position of each of the plurality of canister temperature sensors along the vapor flow path. In any or all of the preceding examples, the method additionally or optionally comprises a filler neck for receiving fuel in the fuel tank, wherein the controller includes further instructions for: responsive to the indication of misfueling, actively locking the filler neck.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

responsive to misfueling of a fuel tank identified based on an actual temperature profile at a fuel system canister during a refueling event relative to an expected temperature profile, the expected temperature profile based on a fuel level in the fuel tank, disabling further addition of fuel during the refueling event, wherein indicating misfueling includes indicating that an actual fuel being received in the fuel tank is different from a desired fuel.

2. The method of claim 1, wherein disabling further addition of fuel during the refueling event includes raising a pressure in a filler neck configured to receive fuel from a fuel dispenser by closing one or more of a fuel tank isolation valve coupling the fuel tank to the fuel system canister and a vent valve coupling the fuel system canister to atmosphere.

3. The method of claim 1, wherein the actual fuel has a lower volatility than the desired fuel.

4. The method of claim 1, wherein the actual temperature profile is estimated via one or more thermocouples spaced along a vapor flow path within the fuel system canister.

5. The method of claim 4, wherein the fuel level in the fuel tank during the refueling event is inferred based on an output of the one or more thermocouples.

6. The method of claim 4, wherein the fuel tank is coupled to an engine of a hybrid electric vehicle, and wherein the one or more thermocouples are spaced symmetrically or asymmetrically along the vapor flow path within the fuel system canister.

7. A method, comprising:

responsive to misfueling of a fuel tank identified based on an actual temperature profile at a fuel system canister during a refueling event relative to an expected temperature profile, the expected temperature profile based on a fuel level in the fuel tank, disabling further addition of fuel during the refueling event, wherein the actual temperature profile is estimated via one or more thermocouples spaced along a vapor flow path within the fuel system canister, and wherein the expected temperature profile includes an expected temperature gain and an expected inflection point for each of the one or more thermocouples as a function of time since a start of the refueling event, the expected temperature profile further based on a volatility of the fuel.

8. The method of claim 7, wherein the expected temperature profile based on the fuel level in the fuel tank includes, as the fuel level in the fuel tank increases during the refueling event, increasing the expected temperature gain.

9. The method of claim 7, wherein the expected temperature gain and the expected inflection point for each of the one or more thermocouples is further based on a position of the one or more thermocouples within the fuel system canister relative to a vapor inlet and a vapor outlet of the fuel system canister.

10. The method of claim 7, wherein indicating misfueling further includes indicating misfueling responsive to an actual temperature gain of the actual temperature profile being lower than the expected temperature gain of the expected temperature profile.

11. The method of claim 10, wherein the indicating further includes indicating misfueling responsive to an actual inflection point of the actual temperature profile being earlier than the expected inflection point of the expected temperature profile.

12. A method, comprising:

while receiving fuel in a fuel tank, monitoring a temperature change at each of a plurality of temperature sensors spaced along a vapor flow path within a carbon canister;

responsive to the temperature change at each of the plurality of temperature sensors being higher than a corresponding threshold, continuing to receive the fuel in the fuel tank by maintaining a valve coupling the fuel tank to the carbon canister open; and responsive to the temperature change at any one of the plurality of temperature sensors being lower than the corresponding threshold, discontinuing further receipt of the fuel in the fuel tank by closing the valve, and indicating that the fuel is an incorrect fuel.

13. The method of claim 12, wherein the corresponding threshold includes a distinct threshold for each of the plurality of temperature sensors, and wherein the corresponding threshold is adjusted based on a fuel level in the fuel tank, an ambient temperature, and a position of each of the plurality of temperature sensors along the vapor flow path.

14. The method of claim 13, wherein indicating that the fuel is an incorrect fuel responsive to the temperature change being lower than the corresponding threshold includes indicating that the fuel is an incorrect fuel responsive to a weighted temperature change, wherein the temperature change of a first of the plurality of temperature sensors located more downstream of a canister vapor inlet is weighted higher than the temperature change of a second of the plurality of temperature sensors located less downstream of the canister vapor inlet.

15. The method of claim 12, wherein indicating that the fuel is an incorrect fuel includes indicating that the fuel received in the fuel tank has a lower volatility than a desired fuel.

16. The method of claim 12, wherein discontinuing further receipt of the fuel in the fuel tank further includes raising a pressure at a filler neck configured to receive fuel in the fuel tank from a fuel dispenser by closing the valve.

* * * * *